US007636538B2

(12) United States Patent
Okamoto et al.

(10) Patent No.: US 7,636,538 B2
(45) Date of Patent: Dec. 22, 2009

(54) LAYER-THICKNESS RESTRICTION MEMBER, DEVELOPING DEVICE, METHOD FOR MANUFACTURING RESTRICTION BLADE, AND BLADE-FORMING MOLD

(75) Inventors: Katsumi Okamoto, Azumino (JP); Hidetoshi Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 11/741,636

(22) Filed: Apr. 27, 2007

(65) Prior Publication Data

US 2007/0253750 A1 Nov. 1, 2007

(30) Foreign Application Priority Data

Apr. 27, 2006 (JP) ..... 2006-124062
Apr. 27, 2006 (JP) ..... 2006-124063

(51) Int. Cl.
*G03G 15/08* (2006.01)
*G03G 15/09* (2006.01)
*G03G 21/00* (2006.01)

(52) U.S. Cl. ..... 399/284; 399/283; 399/274; 399/273; 399/350

(58) Field of Classification Search ..... 399/284, 399/274, 273, 283, 350
See application file for complete search history.

(56) References Cited

U.S. PATENT DOCUMENTS

| | | | | |
|---|---|---|---|---|
| 6,659,750 | B1 * | 12/2003 | Overmyer et al. | 425/3 |
| 2004/0009325 | A1 * | 1/2004 | Sameshima et al. | 428/131 |
| 2005/0260014 | A1 * | 11/2005 | Nakano et al. | 399/284 |
| 2006/0056880 | A1 * | 3/2006 | Okamoto | 399/284 |

FOREIGN PATENT DOCUMENTS

| | | |
|---|---|---|
| JP | 07-295361 | 11/1995 |
| JP | 11-161009 | 6/1999 |
| JP | 2002-264132 | 9/2002 |
| JP | 2003-029528 | 1/2003 |
| JP | 2005-144840 | 6/2005 |
| JP | 2005-237051 | 9/2005 |
| JP | 2005-246957 | 9/2005 |
| JP | 2006-084550 | 3/2006 |

* cited by examiner

*Primary Examiner*—David M Gray
*Assistant Examiner*—Rodney Bonnette
(74) *Attorney, Agent, or Firm*—Hogan & Hartson LLP

(57) ABSTRACT

A layer-thickness restriction member, including: an abutting surface that is for abutting against a developer-bearing body in order to restrict a layer thickness of developer borne by the developer-bearing body; and a flash that is located on a side close to a non-abutting surface that is located on an opposite side from the abutting surface in a thickness direction of the layer-thickness restriction member.

9 Claims, 16 Drawing Sheets

LAYER-THICKNESS RESTRICTION MEMBER, DEVELOPING DEVICE, METHOD FOR MANUFACTURING RESTRICTION BLADE, AND BLADE-FORMING MOLD

CROSS-REFERENCE TO RELATED APPLICATIONS

The present application claims priority from Japanese Patent Application No. 2006-124062 filed on Apr. 27, 2006, and Japanese Patent Application No. 2006-124063 filed on Apr. 27, 2006, which are herein incorporated by reference.

BACKGROUND

1. Technical Field

The invention relates to layer-thickness restriction members, developing devices, methods for manufacturing restriction blades, and blade-forming molds.

2. Related Art

Image forming apparatuses such as a laser beam printer have been well-known. Such image forming apparatuses are furnished with an image bearing body that is for bearing a latent image, and a developing device that develops a latent image borne by the image bearing body with developer, for example. When image signals and the like are transmitted from an external device, such as a host computer, the image forming apparatus develops a latent image borne by the image bearing body using developer contained in the developing device, and forms a developer image. And then, the developer image is transferred onto a medium, and an image is finally formed on the medium.

In order to realize the above-mentioned functions, etc. for developing a latent image borne by the image bearing body, the above-mentioned developing device includes a developer-bearing body that bears developer and a layer-thickness restriction member (a restriction blade including the layer-thickness restriction member) that is for restricting a layer thickness of developer borne by the developer-bearing body by abutting against the developer-bearing body at an abutting surface. In this developing device, the layer-thickness restriction member restricts a layer thickness of developer borne by the developer-bearing body, and the developing device develops a latent image borne by the image bearing body with the developer whose layer thickness is restricted.

It is desirable that a layer thickness of developer restricted by the layer-thickness restriction member is even. This is because, if a layer thickness of developer is uneven, there are cases in which, for example, streaks, etc. appear in a developer image developed by the developer-bearing body and the quality of the developer image deteriorates.

By the way, the above-mentioned layer-thickness restriction member is a molded article, and there are cases in which a flash is created when molding this layer-thickness restriction member. The above-mentioned flash means an unnecessary section that is squeezed out of edge of the layer-thickness restriction member and the like when molding (processing) resin, and the like. It can be considered to remove the created flash, but there are cases in which the flash is not removed in order to simplify processes for manufacturing a layer-thickness restriction member. However, if the flash is not removed, when the flash is located close to the developer-bearing body, there is a possibility in which the layer-thickness restriction member restricts unevenly a layer thickness of developer borne by the developer-bearing body.

Further, for example, the restriction blade includes an abutting member that abuts against the developer-bearing body at an abutting surface, and a supporting member to which an adhering surface of the abutting member adheres and that is for supporting the abutting member, the adhering surface being located on an opposite side from the abutting surface in a thickness direction of the abutting member.

As a method for manufacturing the restriction blade, there is known a method for obtaining the restriction blade in which the abutting member and the supporting member are separately molded or formed in any other way and the adhering surface of the molded abutting member and the molded supporting member adhere to each other. And, there are cases of employing, as a method for molding the abutting member, a method for molding the abutting member by injection molding by injecting material of the abutting member into a mold that includes a first mold that includes an abutting-surface forming section for forming the abutting surface, and a second mold that includes an adhering-surface forming section for forming the adhering surface and that is movable relative to the first mold.

By the way, if the abutting member is molded by injection molding, a flash is likely to be created on a section of a boundary surface between the first mold and the second mold when molding the abutting member by injection molding. If the supporting member and the adhering surface, of the abutting member, on which the flash is created adhere to each other, there are cases in which the adhering surface does not adhere to the supporting member properly, and there is a possibility that this makes the precision of the manufactured restriction blade deteriorate.

Note that JP-A-2005-144840 and JP-A-2006-84550 are examples of a related art.

SUMMARY

The invention has been made in view of the above issues. An advantage of some aspects of the invention is to achieve a layer-thickness restriction member that can evenly restrict a layer thickness of developer borne by a developer-bearing body.

An aspect of the invention is the following layer-thickness restriction member.

A layer-thickness restriction member, including:

an abutting surface that is for abutting against a developer-bearing body in order to restrict a layer thickness of developer borne by the developer-bearing body; and a flash that is located on a side close to a non-abutting surface that is located on an opposite side from the abutting surface in a thickness direction of the layer-thickness restriction member.

Besides, the invention has been made in view of the above issues. Another advantage of some aspects of the invention is to achieve a method for manufacturing a restriction blade in which a high-precision restriction blade can be manufactured.

Another aspect of the invention is the following method for manufacturing a restriction blade.

A method for manufacturing a restriction blade, including:

molding by injection molding an abutting member, made of thermoplastic elastomer, of a restriction blade that is for restricting, by abutting against a developer-bearing body, a layer thickness of developer borne by the developer-bearing body by injecting the thermoplastic elastomer into a mold that includes a first mold that includes an abutting-surface forming section for forming an abutting surface of the abutting member, and a second mold that includes an adhering-surface forming section for forming an adhering surface, of the abutting member, located on an opposite side from the abutting surface in a thickness direction of the abutting member, and that is movable relative to the first mold, the first mold and the second mold overlapping such that a boundary surface between the first mold and the second mold is located between these two molds in a direction from the abutting-surface forming section toward the adhering-surface forming section;

making the adhering surface of the abutting member that is molded by injection molding and a supporting member that is included in the restriction blade and that is for supporting the abutting member adhere to each other.

Other features of the invention will become clear by the accompanying drawings and the description hereinbelow.

BRIEF DESCRIPTION OF THE DRAWINGS

For a more complete understanding of the invention and the advantages thereof, reference is now made to the following description taken in conjunction with the accompanying drawings.

DESCRIPTION OF EXEMPLARY EMBODIMENTS

Figure 1:
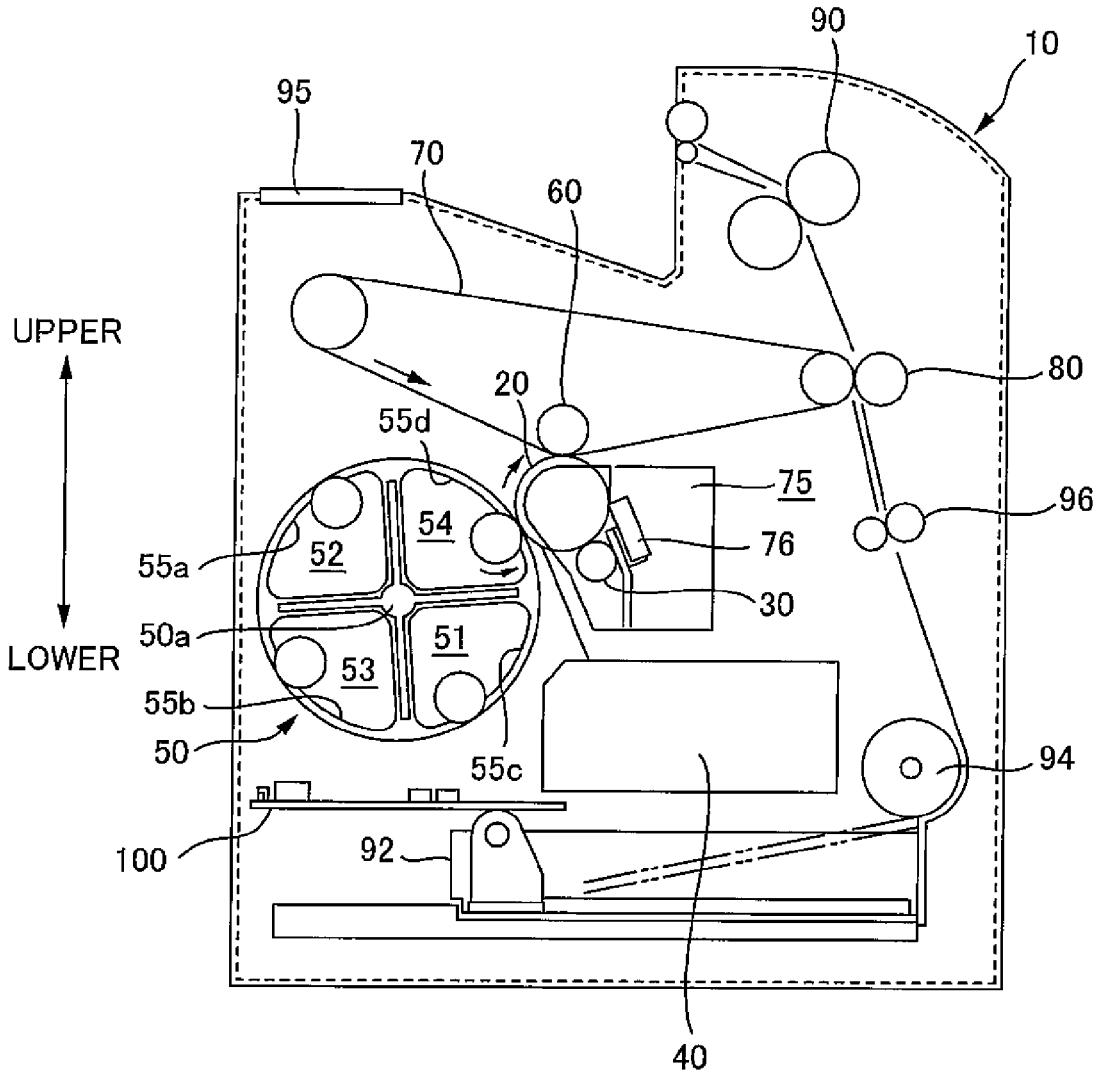
FIG. 1 is a diagram showing main components structuring a printer 10.

At least the following matters will be made clear by the description in the present specification and the accompanying drawings.

A layer-thickness restriction member, including:

an abutting surface that is for abutting against a developer-bearing body in order to restrict a layer thickness of developer borne by the developer-bearing body; and a flash that is located on a side close to a non-abutting surface that is located on an opposite side from the abutting surface in a thickness direction of the layer-thickness restriction member.

If the flash of the layer-thickness restriction member is located on the side close to the non-abutting surface that is located on the opposite side from the abutting surface in the thickness direction, the flash is unlikely to affect the layer thickness of the developer, so that the layer thickness of the developer can be restricted evenly.

In addition, a base of the flash may be located between the abutting surface and the non-abutting surface in the thickness direction; and the flash may include a flash whose edge is located on a side close to the abutting surface with respect to the base in the thickness direction, and a flash whose edge is located on a side close to the non-abutting surface with respect to the base in the thickness direction.

If the flash includes the flash whose edge is located on the side close to the abutting surface with respect to the base in the thickness direction, and the flash whose edge is located on the side close to the non-abutting surface with respect to the base, the flashes are located unevenly in the thickness direction and this increases a possibility that the layer thickness of the developer becomes unevenly. Therefore, an effect generated by positioning the flash on the side close to the non-abutting surface in the thickness direction, that is, an effect that the layer thickness of the developer is restricted evenly, is achieved more effectively.

In addition, the layer-thickness restriction member may include a first portion that includes the abutting surface and that is located on a one-end side in the thickness direction, and a second portion that includes the non-abutting surface and that is located on an other-end side in the thickness direction and is connected to the first portion; and a length of the first portion in a transverse direction of the layer-thickness restriction member may be larger than a length of the second portion in the transverse direction.

In addition, a base of the flash may be located on an edge of a surface, of the first portion, that is located on the opposite side from the abutting surface; and a length of the first portion in the thickness direction may be larger than a length of the second portion in the thickness direction.

In the case where the base of the flash is located on the edge of the surface, of the first portion, that is located on the opposite side from the abutting surface, if the length of the first portion in the thickness direction is larger than the length of the second portion in thickness direction, it is possible to position the flash on the side close to the non-abutting surface even in a simple configuration.

In addition, a ten-point average height of irregularities of the abutting surface may be smaller than a ten-point average height of irregularities of the non-abutting surface.

In such a case, projections and depressions of the abutting surface are small, and this enables to more evenly restrict the layer thickness of the developer borne by the developer-bearing body.

In addition, a first curve may be formed on an edge of the abutting surface; a second curve may be formed on an edge of the non-abutting surface; and a radius of curvature of the first curve may be smaller than a radius of curvature of the second curve.

If the radius of curvature of the first curve is smaller than the radius of curvature of the second curve, the edge of the abutting surface on which the first curve is formed can be sharpened. In this case, it is possible to more effectively bring the developer between the abutting surface and the developer-bearing body.

In addition, the layer-thickness restriction member may be made of thermoplastic elastomer.

In such a case, a layer-thickness restriction member with great accuracy of thickness is easy to be molded.

A layer-thickness restriction member, including:

an abutting surface that is for abutting against a developer-bearing body in order to restrict a layer thickness of developer borne by the developer-bearing body;

a flash that is located on a side close to a non-abutting surface that is located on an opposite side from the abutting surface in a thickness direction of the layer-thickness restriction member;

wherein, a base of the flash is located between the abutting surface and the non-abutting surface in the thickness direction;

the flash includes a flash whose edge is located on a side close to the abutting surface with respect to the base in the thickness direction, and a flash whose edge is located on a side close to the non-abutting surface with respect to the base in the thickness direction;

the layer-thickness restriction member includes a first portion that includes the abutting surface and that is located on a one-end side in the thickness direction, and a second portion that includes the non-abutting surface and that is located on an other-end side in the thickness direction and is connected to the first portion;

a length of the first portion in a transverse direction of the layer-thickness restriction member is larger than a length of the second portion in the transverse direction;

the base of the flash is located on an edge of a surface, of the first portion, that is located the opposite side from the abutting surface;

a length of the first portion in the thickness direction is larger than a length of the second portion in the thickness direction;

a ten-point average height of irregularities of the abutting surface is smaller than a ten-point average height of irregularities of the non-abutting surface;

a first curve is formed on an edge of the abutting surface;

a second curve is formed on an edge of the non-abutting surface;

a radius of curvature of the first curve is smaller than a radius of curvature of the second curve; and the layer-thickness restriction member is made of thermoplastic elastomer.

With this layer-thickness restriction member, an effect that the layer thickness of the developer is restricted evenly is achieved most effectively.

A developing device, including:

a developer-bearing body that is for bearing developer; and a layer-thickness restriction member that includes an abutting surface that is for abutting against the developer-bearing body in order to restrict a layer thickness of developer borne by the developer-bearing body, and that includes a flash that is located on a side close to a non-abutting surface that is located on an opposite side from the abutting surface in a thickness direction of the layer-thickness restriction member.

With this developing device, the layer thickness of the developer borne by the developer-bearing body can be restricted evenly by the layer-thickness restriction member.

In addition, the developer-bearing body may be a developer-bearing roller that is rotatable about a central axis; a longitudinal direction of the layer-thickness restriction member may be along an axial direction of the developer-bearing body; a base of the flash may be located between the abutting surface and the non-abutting surface in the thickness direction; the flash may include a flash whose edge is located on a side close to the abutting surface with respect to the base in the thickness direction, and a flash whose edge is located on a side close to the non-abutting surface with respect to the base in the thickness direction; and the flash may be located from a longitudinal-direction one end to a longitudinal-direction other end of the layer-thickness restriction member.

If the flash is located from the longitudinal-direction one end to the longitudinal-direction other end, an effect generated by positioning the flash on the side close to the non-abutting surface in the thickness direction, that is, an effect that the layer thickness of the developer is restricted evenly, is achieved more effectively.

In addition, the developing device may include a supporting member to which the non-abutting surface adheres and that is for supporting the layer-thickness restriction member; and none of the flashes may be in contact with the supporting member.

If none of the flashes is in contact with the supporting member, the layer-thickness restriction member is appropriately supported by the supporting member. Therefore, the layer-thickness restriction member can properly abut against the developer-bearing body.

A method for manufacturing a restriction blade, including:

molding by injection molding an abutting member, made of thermoplastic elastomer, of a restriction blade that is for restricting, by abutting against a developer-bearing body, a layer thickness of developer borne by the developer-bearing body by injecting the thermoplastic elastomer into a mold that includes a first mold that includes an abutting-surface forming section for forming an abutting surface of the abutting member, and a second mold that includes an adhering-surface forming section for forming an adhering surface, of the abutting member, located on an opposite side from the abutting surface in a thickness direction of the abutting member, and that is movable relative to the first mold, wherein the first mold and the second mold overlap such that a boundary surface between the first mold and the second mold is located between these two molds in a direction from the abutting-surface forming section toward the adhering-surface forming section;

making the adhering surface of the abutting member that is molded by injection molding and a supporting member that is included in the restriction blade and that is for supporting the abutting member adhere to each other.

In the case where molding by injection molding the abutting member, by injecting the thermoplastic elastomer into the mold wherein the first mold and the second mold overlap such that the boundary surface between the first mold and the second mold is located between these two molds in the direction from the abutting-surface forming section toward the adhering-surface forming section, the flash is located away from the adhering surface even if the flash is created on a section of the boundary surface when molding by injection molding. Therefore, when making the adhering surface and the supporting member adhere to each other, the flash is unlikely to contact the supporting member. Accordingly, the supporting member properly adheres to the adhering surface. This increases the precision of the manufactured restriction blade.

In addition, the mold may be a metal mold; the first mold may have a first depression whose bottom surface is the abutting-surface forming section; the second mold may have a second depression whose bottom surface is the adhering-surface forming section; when the first mold and the second mold overlap, the boundary surface may be located between the first depression and the second depression in the direction from the abutting-surface forming section toward the adhering-surface forming section; and when the abutting member is molded by injection molding, the abutting member may be molded by injection-molding by injecting the thermoplastic elastomer into the first depression and the second depression.

In addition, a depth of the first depression may be larger than a depth of the second depression.

The restriction blade restricts the layer thickness of the developer borne by the developer-bearing body, but there is a possibility in which the layer thickness of the developer is restricted unevenly if the flash of the abutting member that is molded by injection molding is located on the side close to the abutting surface in the thickness direction. On the other hand, if the depth of the first depression is larger than the depth of the second depression, the flash that is created between the first depression and the second depression in injection molding is located on the side close to the adhering surface, among the abutting surface and the adhering surface, in the thickness direction. As a result thereof, it is possible to prevent the layer thickness of the developer borne by the developer-bearing body from being restricted unevenly.

In addition, a width of the first depression in a transverse direction may be larger than a width of the second depression in the transverse direction.

There are cases in which the first mold and the second mold overlap with their positions relative to each other being shifted when the mold is closed. In such a case, if the width of the first depression in the transverse direction is the same as the width of the second depression in the transverse direction, a position at which the flash is created in injection molding is likely to vary when the first mold and the second mold overlap with their relative positions being shifted. On the other hand, if the width of the first depression in the transverse direction is larger than the width of the second depression in the transverse direction, the position at which the flash is created does not vary even when the first mold and the second mold overlap with their positions relative to each other being shifted.

In addition, a shape of the abutting member may be adjusted by cutting both end sections of the abutting member that is molded by injection molding in the longitudinal direction; and when making the adhering surface of the abutting member and the supporting member adhere to each other, the adhering surface of the abutting member whose shape is adjusted and the supporting member may adhere to each other.

In such a case, the flash is not located in the transverse direction of the abutting member. Therefore, the adhering surface of the abutting member that is molded by injection molding and the supporting member can adhere to each other more properly.

In addition, when making the adhering surface of the abutting member and the supporting member adhere to each other, the adhering surface of the abutting member and the supporting member may adhere to each other such that a flash of the abutting member that is molded by injection molding is not in contact with the supporting member.

If the adhering surface of the abutting member and the supporting member adhere to each other such that the flash of the abutting member that is molded by injection molding is not in contact with the supporting member, the adhering surface and the supporting member can adhere to each other more properly.

In addition, when making the adhering surface of the abutting member and the supporting member adhere to each other, the supporting member may be held by a first jig; the abutting member may be held by a second jig such that the flash of the abutting member that is molded by injection molding is not in contact with the second jig; and the adhering surface and the supporting member may adhere to each other in such a manner as to move the first jig holding the supporting member relative to the second jig holding the abutting member so as to become close to each other such that the adhering surface of the abutting member comes in contact with the supporting member.

If the abutting member is held by the second jig such that the flash of the abutting member that is molded by injection molding is not in contact with the second jig, the flash is not sandwiched between the abutting member and the second jig. Therefore, the abutting member is positioned properly with respect to the second jig.

A blade-forming mold, including:

a first mold that includes an abutting-surface forming section for forming an abutting surface of an abutting member, made of thermoplastic elastomer, of a restriction blade that is for restricting, by abutting against a developer-bearing body, a layer thickness of developer borne by the developer-bearing body; and a second mold that is movable relative to the first mold, and that includes an adhering-surface forming section for forming an adhering surface, of the abutting member, that is located on a side opposite the abutting surface in a thickness direction of the abutting member and adheres to a supporting member that is included in the restriction blade and that is for supporting the abutting member;

the first mold and the second mold overlapping such that a boundary surface between the first mold and the second mold is located between these two molds in a direction from the abutting-surface forming section toward the adhering-surface forming section.

With this blade-forming mold, it is possible to manufacture the abutting member whose adhering surface adheres to the supporting member properly.

FIRST EMBODIMENT

Regarding Restriction Blade According to First Embodiment

As mentioned above, a restriction blade is provided in a developing device included in an image forming apparatus, and restricts a layer thickness of toner, which is an example of developer borne by a developing roller, by abutting the developing roller, which is an example of a developer-bearing body.

In this section, an overview of the image forming apparatus is initially described for an example of a laser beam printer (hereinafter referred to as a printer), and thereafter a developing device and a restriction blade are described in sequence.

Overview of Image Forming Apparatus

Figure 2:
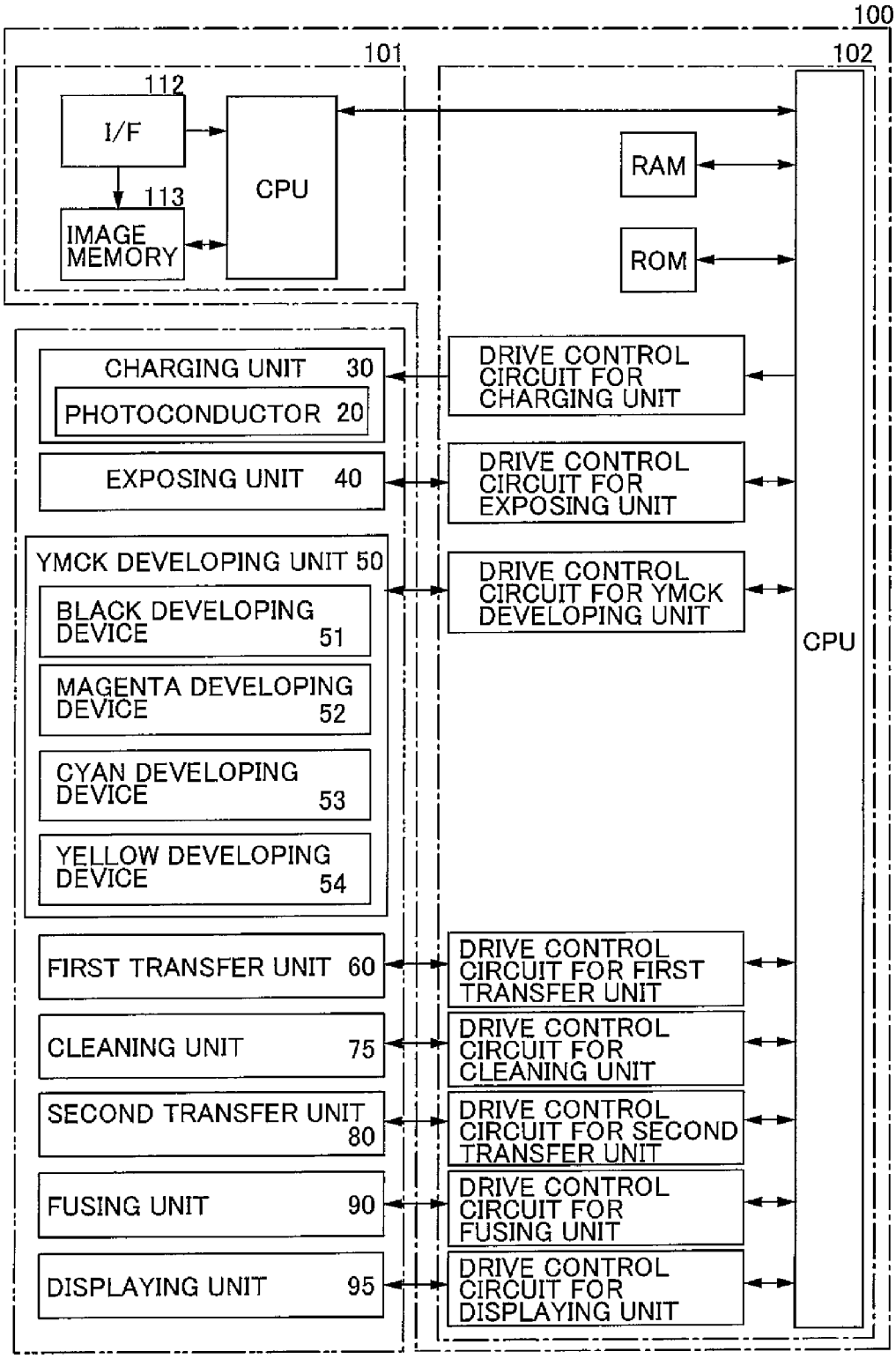
FIG. 2 is a block diagram showing a control unit of the printer 10.

First, examples of configuration and operation of a printer 10 are described with reference to FIGS. 1 and 2. FIG. 1 is a diagram showing main components structuring the printer 10. FIG. 2 is a block diagram showing a control unit of the printer 10 shown in FIG. 1. Note that, in FIG. 1, the arrow indicates the up-and-down direction, and that a paper supply tray 92 is arranged in a lower section of the printer 10 and a fusing unit 90 is arranged in an upper section of the printer 10, for example.

Configuration Example of Printer 10

As shown in FIG. 1, the printer 10 according to the present embodiment includes a charging unit 30, an exposing unit 40, a YMCK developing unit 50, a first transfer unit 60, an intermediate transfer body 70, and a cleaning unit 75, and they are provided along a rotating direction of a photoconductor 20, which is an example of an image bearing body. In addition, the printer 10 includes a second transfer unit 80, the fusing unit 90, a displaying unit 95 that serves as means for making notifications to users and that is constructed of a liquid-crystal panel, and a control unit 100 that controls these units, etc. and that manages operations as a printer.

The photoconductor 20 has a cylindrical conductive base and a photoconductive layer formed on an outer peripheral surface of the base. The photoconductor 20 is rotatable about its central axis, and rotates clockwise in this embodiment, as indicated by the arrow in FIG. 1.

The charging unit 30 is a device for charging the photoconductor 20. The exposing unit 40 is a device that forms a latent image on the charged photoconductor 20 by radiating laser beams thereon. The exposing unit 40 has a semiconductor laser, a polygon mirror, an F-θ lens, and the like, and radiates modulated laser beams onto the charged photoconductor 20 according to image information (image signals) that has been inputted by a not-shown host computer, such as a personal computer and a word processor.

YMCK developing unit 50 is a device for developing a latent image that is formed on the photoconductor 20, using toners contained in the developing device, that is, a black (K) toner contained in a black developing device 51, a magenta (M) toner contained in a magenta developing device 52, a cyan (C) toner contained in a cyan developing device 53, and a yellow (Y) toner contained in a yellow developing device 54.

The YMCK developing unit 50 rotates with the four developing devices 51, 52, 53, 54 being attached thereto so that it enables to move positions of the four developing devices 51, 52, 53, 54. More specifically, the YMCK developing unit 50 holds the four developing devices 51, 52, 53, 54 with four holding sections 55*a*, 55*b*, 55*c*, 55*d*, and the four developing devices 51, 52, 53, 54 are rotatable about a central axis 50*a* while keeping their respective positions relatively. Every time an image forming process for one page is finished, the four developing devices 51, 52, 53, 54 selectively opposes the photoconductor 20, and successively develops a latent image formed on the photoconductor 20, using toners contained in each of the developing devices 51, 52, 53, 54. Note that, the above-mentioned four developing devices 51, 52, 53, 54 are attachable to and detachable from the respective holding sections of the YMCK developing unit 50. Details of each developing device will be described later.

The first transfer unit 60 is a device for transferring a single-color toner image formed on the photoconductor 20, onto the intermediate transfer body 70. When toners of four colors are successively transferred in a superposed manner, a full-color toner image is formed on the intermediate transfer body 70.

The intermediate transfer body 70 is an endless belt that is made by providing a tin layer by vapor deposition on a surface of a PET film and further applying and laminating semiconducting coating on the outer layer thereof. The intermediate transfer body 70 is driven and rotated at the approximately same circumferential speed as the photoconductor 20.

The second transfer unit 80 is a device for transferring the single-color toner image or the full-color toner image formed on the intermediate transfer body 70, onto a medium, such as paper, film, and cloth.

The fusing unit 90 is a device for fusing, onto the medium, the single-color toner image or the full-color toner image that have been each transferred onto the medium, to make the image into a permanent image.

The cleaning unit 75 is provided between the first transfer unit 60 and the charging unit 30, and includes a cleaning blade 76 that is for cleaning the photoconductor 20 by abutting against the photoconductor 20 and scraping off toner that remains on the photoconductor 20. The cleaning unit 75 is a device for removing the toner that remains on the photoconductor 20, by scraping off toner with the cleaning blade 76 after the toner image has been transferred onto the intermediate transfer body 70 by the first transfer unit 60.

The control unit 100 is configured by a main controller 101 and a unit controller 102, as shown in FIG. 2; image signals and control signals are inputted to the main controller 101, and the unit controller 102 controls each of the above-mentioned units and forms an image according to instructions based on these image signals and control signals.

More specifically, the main controller 101 of the control unit 100 is connected to the host computer via an interface 112, and is furnished with an image memory 113 for storing image signals inputted by the host computer. The unit controller 102 is electrically connected to the units in the body of the apparatus (the charging unit 30, the exposing unit 40, the YMCK developing unit 50, the first transfer unit 60, the cleaning unit 75, the second transfer unit 80, the fusing unit 90, and the displaying unit 95). The unit controller 102 detects states of the units by receiving signals from sensors provided in these units, and controls these units based on signals inputted by the main controller 101.

Example of Operation of Printer 10

Next, operations of the printer 10 having the above-mentioned configuration are described.

When image signals and control signals are inputted from the not-shown host computer to the main controller 101 of the printer 10 via the interface (I/F)112, the photoconductor 20, the developing roller, and the intermediate transfer body 70 rotate under control of the unit controller 102 according to instructions from the main controller 101. While rotating, the photoconductor 20 is successively charged by the charging unit 30 at a charging position.

With rotation of the photoconductor 20, the charged area of the photoconductor 20 reaches an exposing position. A latent image that corresponds to image information for a first color, for example yellow Y, is formed in the area by the exposing unit 40. Further, in the YMCK developing unit 50, the yellow developing device 54 containing the yellow (Y) toner is located at a developing position that opposes the photoconductor 20.

With rotation of the photoconductor 20, the latent image formed on the photoconductor 20 reaches the developing position, and is developed by the yellow developing device 54 with the yellow toner. As a result thereof, a yellow toner image is formed on the photoconductor 20.

With rotation of the photoconductor 20, the yellow toner image formed on the photoconductor 20 reaches a first transfer position, and is transferred onto the intermediate transfer body 70 by the first transfer unit 60. At this stage, a first transfer voltage, which is in an opposite polarity to the polarity to which the toner is charged is applied to the first transfer unit 60. Note that, during this process, the photoconductor 20 and the intermediate transfer body 70 are placed in contact with each other and the second transfer unit 80 is separated from the intermediate transfer body 70.

By performing successively the above-mentioned process for each of the developing devices associating with a second color, a third color, and a fourth color respectively, toner images in the respective four colors associated with the image signals are transferred onto the intermediate transfer body 70 in a superposed manner. As a result thereof, a full-color toner image is formed on the intermediate transfer body 70.

With rotation of the intermediate transfer body 70, the full-color toner image formed on the intermediate transfer body 70 reaches a second transfer position, and is transferred onto a medium by the second transfer unit 80. Note that the medium is transported from the paper supply tray 92 to the second transfer unit 80 via a paper supply roller 94 and resisting rollers 96. Besides, during the transfer operation, the second transfer unit 80 is pressed against the intermediate transfer body 70 and a second transfer voltage is applied to the second transfer unit 80.

The full-color toner image transferred onto the medium is heated and pressurized by the fusing unit 90, and is fused to the medium.

On the other hand, after the photoconductor 20 has passed the first transfer position, toner adhering to a surface of the photoconductor 20 is scraped off by the cleaning blade 76 that is provided in the cleaning unit 75, and the photoconductor 20 is prepared for charging that is for formation of a next latent image. The scraped toner T is collected by a residual toner collector included in the cleaning unit 75.

Overview of Developing Device

Figure 3:
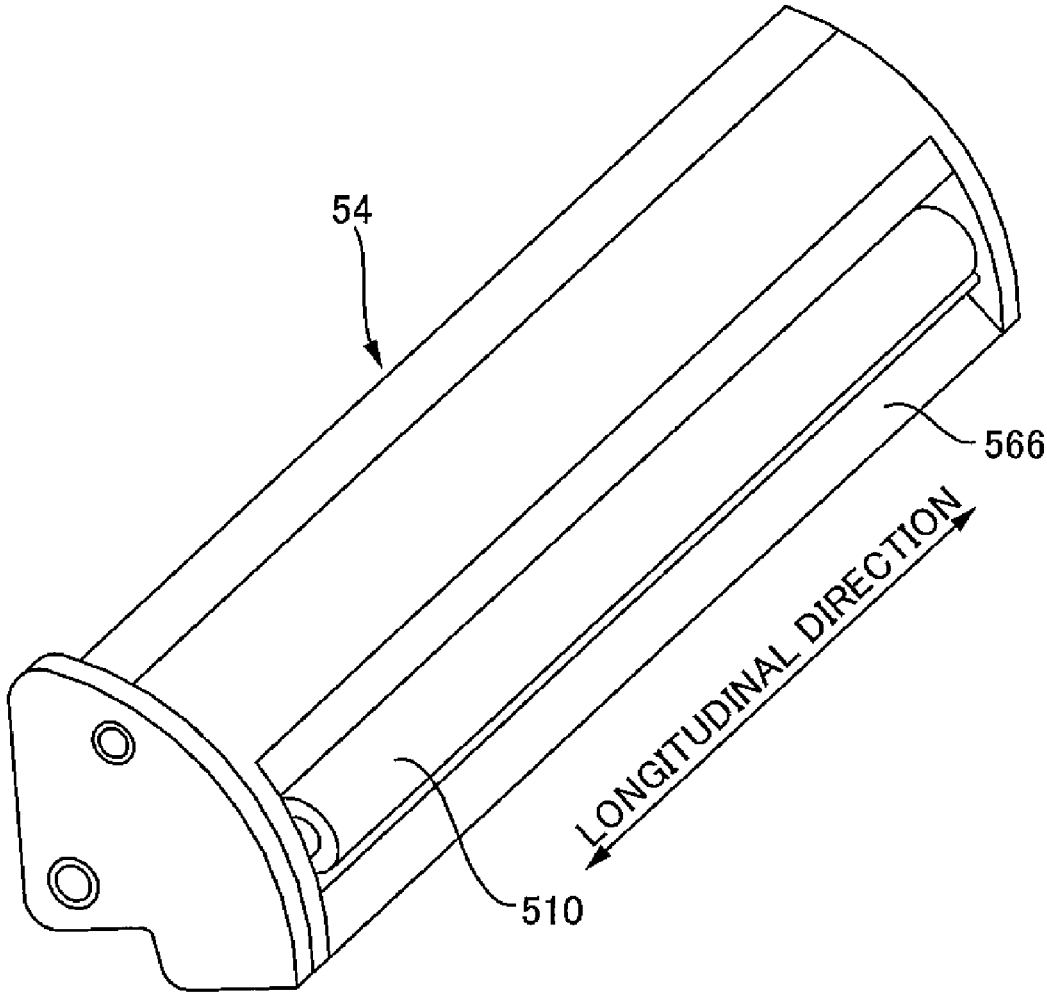
FIG. 3 is a diagram conceptually showing a developing device.
Figure 4:
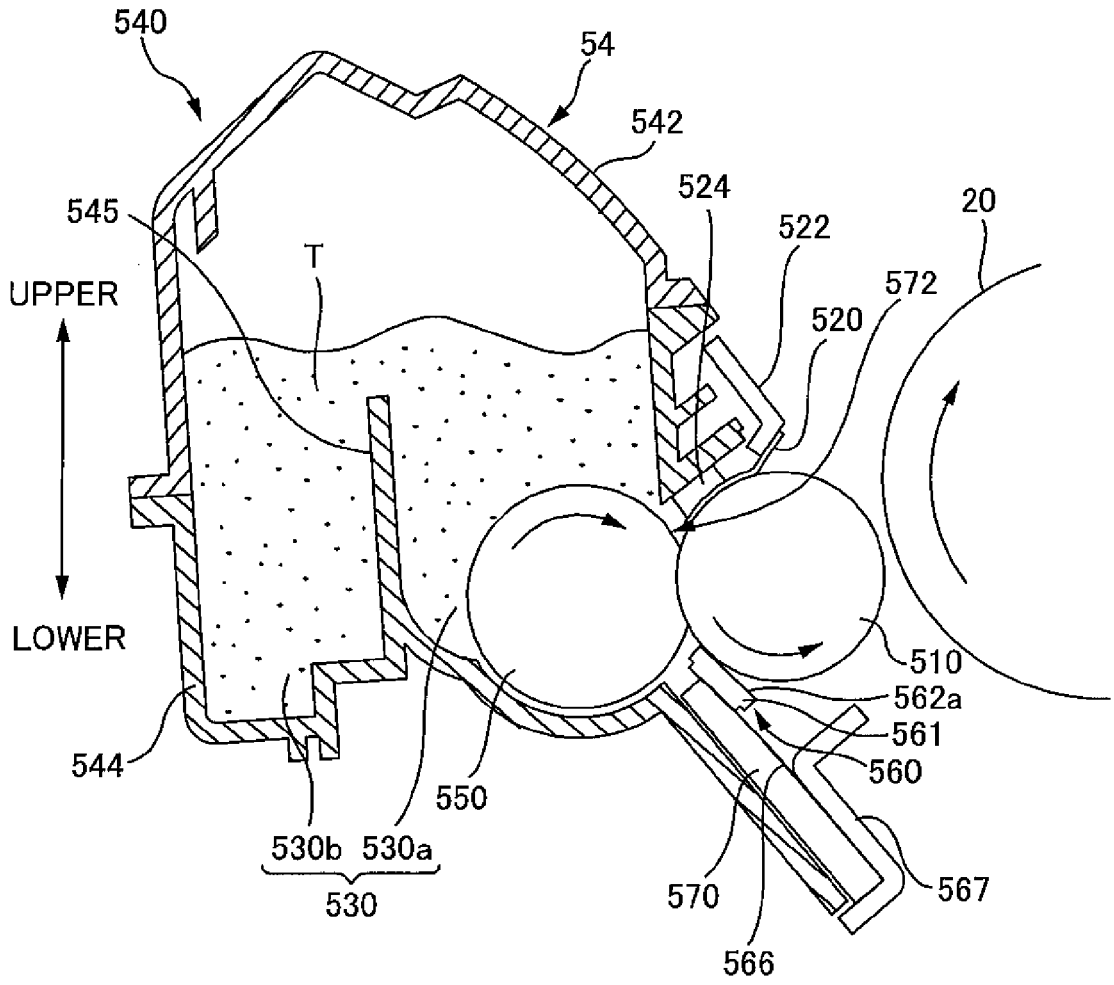
FIG. 4 is a cross-sectional view showing main structural components of the developing device according to the first embodiment.

Next, examples of a configuration and operations of the developing device are described with reference to FIGS. 3 and 4. FIG. 3 is a diagram conceptually showing the developing device. FIG. 4 is a cross-sectional view showing main structural components of the developing device. Note that the cross-sectional view shown in FIG. 4 shows a cross-section of the developing device when cut by a plane perpendicular to the longitudinal direction that is shown in FIG. 3. In FIG. 4, in the same way as FIG. 1, the arrow indicates the up-and-down direction, and for example, a central axis of a developing roller 510 is located below a central axis of the photoconductor 20. Besides, in FIG. 4, the yellow developing device 54 is shown being located at the developing position that opposes the photoconductor 20.

The YMCK developing unit 50 is furnished with the black developing device 51 containing the black (K) toner, the magenta developing device 52 containing the magenta (M) toner, the cyan developing device 53 containing the cyan (C) toner, and the yellow developing device 54 containing the yellow (Y) toner. However, only the yellow developing device 54 is described below, because the configuration of each developing device is same.

Configuration Example of Developing Device

The yellow developing device 54 includes the developing roller 510, an upper sealing member 520, a toner containing body 530, a housing 540, a toner supply roller 550, a restriction blade 560, and the like.

The developing roller 510 bears toner T to transport it to the developing position that opposes the photoconductor 20. The developing roller 510 is made of aluminum, stainless steel, iron, etc. and is nickel-plated, chrome-plated, or the like as necessary. Besides, as shown in FIG. 3, the developing roller 510 is provided such that its longitudinal direction is along a longitudinal direction of the yellow developing device 54. The developing roller 510 is rotatable about its central axis, and rotates in a direction (counterclockwise in FIG. 4) opposite the rotating direction of the photoconductor 20 (clockwise in FIG. 4) as shown in FIG. 4. The central axis is located below the central axis of the photoconductor 20.

Further, when the yellow developing device 54 opposes the photoconductor 20, a gap exists between the developing roller 510 and the photoconductor 20. In other words, the yellow developing device 54 develops a latent image formed on the photoconductor 20 without contacting. Note that, when developing the latent image formed on the photoconductor 20, alternating electric field is generated between the developing roller 510 and the photoconductor 20.

The upper sealing member 520 prevents toner T in the yellow developing device 54 from spilling outside, and collects, into the developing device, toner T that has passed through the developing position and is on the developing roller 510, without scraping off the toner. The upper sealing member 520 is a seal made of polyethylene film, etc. The upper sealing member 520 is supported by an upper-seal supporting metal plate 522, and is mounted on the housing 540 via the upper-seal supporting metal plate 522. Besides, an upper-seal urging member 524 made of Moltoprene, etc. is provided on the upper sealing member 520 on a side opposite from a side close to the developing roller 510. The upper sealing member 520 is pressed against the developing roller 510 by elastic force of the upper-seal urging member 524. Note that an abutting position at which the upper sealing member 520 abuts against the developing roller 510 is located above the central axis of the developing roller 510.

The housing 540 is manufactured by welding together a plurality of housing sections that are integrally molded: a housing upper section 542 and a housing lower section 544. In the housing 540, the toner containing body 530 for containing toner T is formed. The toner containing body 530 is separated into two toner containers, namely, a first toner container 530*a* and a second toner container 530*b*, by a partitioning wall 545 which protrudes inwardly from an inner wall (to the up-and-down direction in FIG. 4) and is for separating toner T. The first toner container 530*a* and the second toner container 530*b* are connected to each other at their respective upper sections. In the state shown in FIG. 4, the partitioning wall 545 restricts movement of toner T. However, when the YMCK developing unit 50 rotates, toner T contained in the first toner container 530*a* and the second toner container 530*b* is once gathered in the connected section on an upper side in the developing position. When returning to the state shown in FIG. 4, the toner T is mixed and is moved back to the first toner container 530*a* and the second toner container 530*b*. In other words, by rotation of the YMCK developing unit 50, toner T in the developing device is stirred appropriately.

Therefore, in this embodiment, the toner containing body 530 is not furnished with a stirring member, but it is possible to provide a stirring member for stirring toner T that is contained in the toner containing body 530. Further, as shown in FIG. 4, the housing 540 (more specifically, the first toner container 530*a*) includes an opening 572 in a lower section thereof, and the developing roller 510 is provided facing the opening 572.

The toner supply roller 550 is provided to the above-mentioned first toner container 530*a*. The toner supply roller 550 supplies to the developing roller 510 toner T contained in the first toner container 530*a*, as well as scrapes off, from the developing roller 510, toner T that remains on the developing roller 510 after development. The toner supply roller 550 is made of polyurethane foam, etc., and abuts against the developing roller 510 while being deformed elastically. The toner supply roller 550 is located in the lower section of the first toner container 530*a*, and toner T contained in the first toner container 530*a* is supplied to the developing roller 510 by the toner supply roller 550 at the lower section of the first toner container 530*a*. The toner supply roller 550 is rotatable about its central axis, and the central axis is located below the central axis of rotation of the developing roller 510. Further, the toner supply roller 550 rotates in a direction (clockwise in FIG. 4) opposite a rotating direction of the developing roller 510 (counterclockwise in FIG. 4).

The restriction blade 560 restricts a layer thickness of toner T borne by the developing roller 510, and also charges electrically toner T borne by the developing roller 510. The restriction blade 560 includes a rubber section 561 serving as an example of a layer-thickness restriction member that is for restricting a layer thickness of toner borne by the developing roller 510, and a rubber-supporting section 566 serving as an example of a supporting member that is for supporting the rubber section 561. Note that the configuration of the restriction blade 560 is described later in detail.

Example of Operation of Developing Device

In the yellow developing device 54 constructed as mentioned above, the toner supply roller 550 supplies, to the developing roller 510, toner T contained in the toner containing body 530. With rotation of the developing roller 510, the toner T supplied to the developing roller 510 reaches an abutting position of the restriction blade 560; on passing through the abutting position, a layer thickness is restricted and the toner T is charged electrically. With further rotation of the developing roller 510, the charged toner T which is on the developing roller 510 and whose layer thickness is restricted reaches the developing position that opposes the photoconductor 20, and is used at the developing position in development of a latent image formed on the photoconductor 20 under alternating electric field. The toner T that is on the developing roller 510 and that has passed through the developing position with further rotation of the developing roller 510 passes through the upper sealing member 520, and the toner T is collected into the developing device without being scraped off by the upper sealing member 520. Furthermore, toner T that still remains on the developing roller 510 can be scraped off by the toner supply roller 550.

Configuration Example of Restriction Blade

Figure 5:
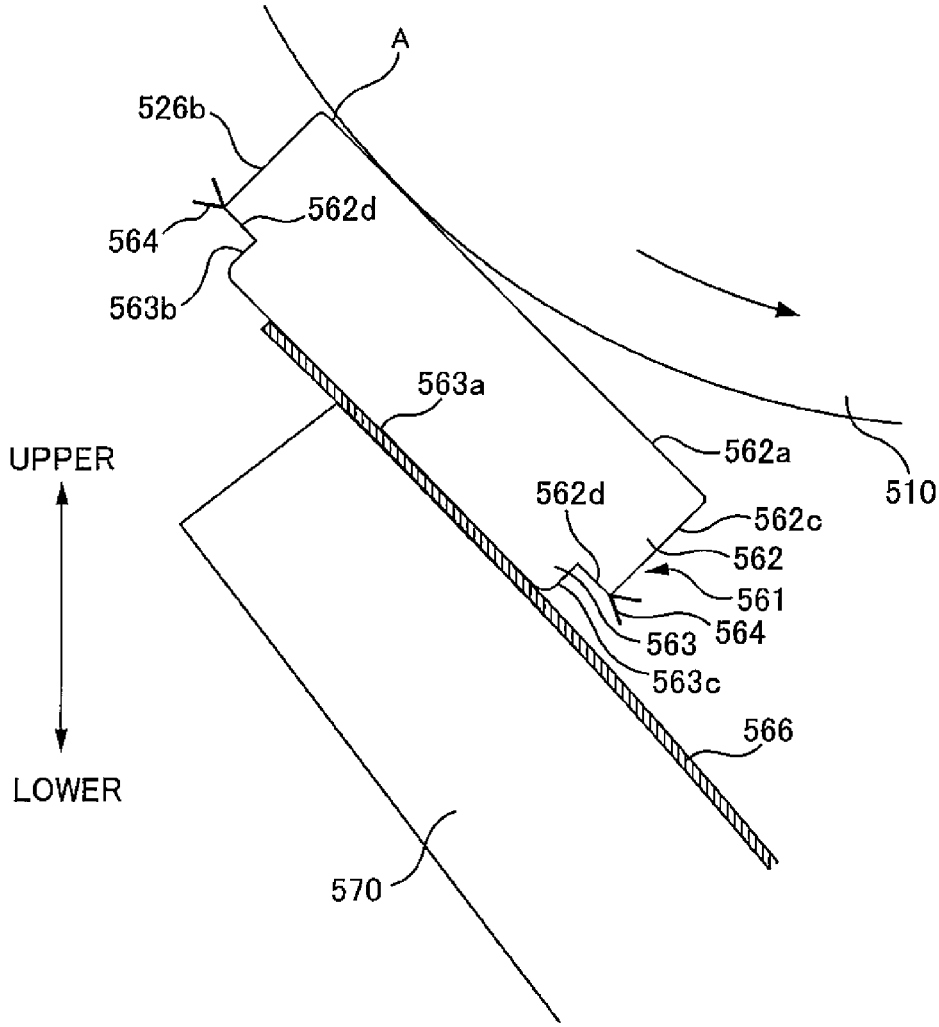
FIG. 5 is a diagram showing a state in which a restriction blade 560 according to the first embodiment abuts against a developing roller 510.
Figure 6:
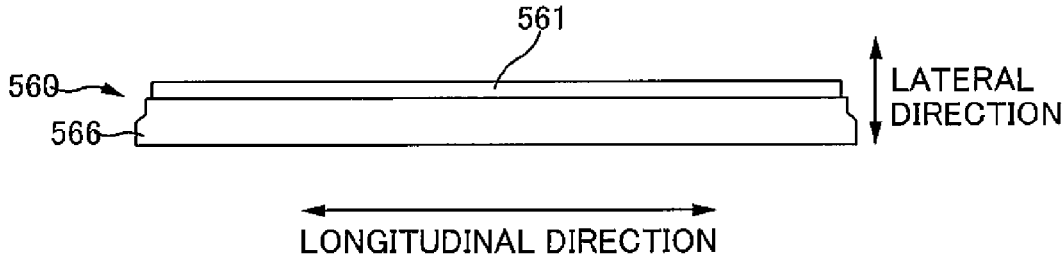
FIG. 6 is an explanatory diagram showing the configuration of the restriction blade 560 according to the first embodiment.
Figure 7:
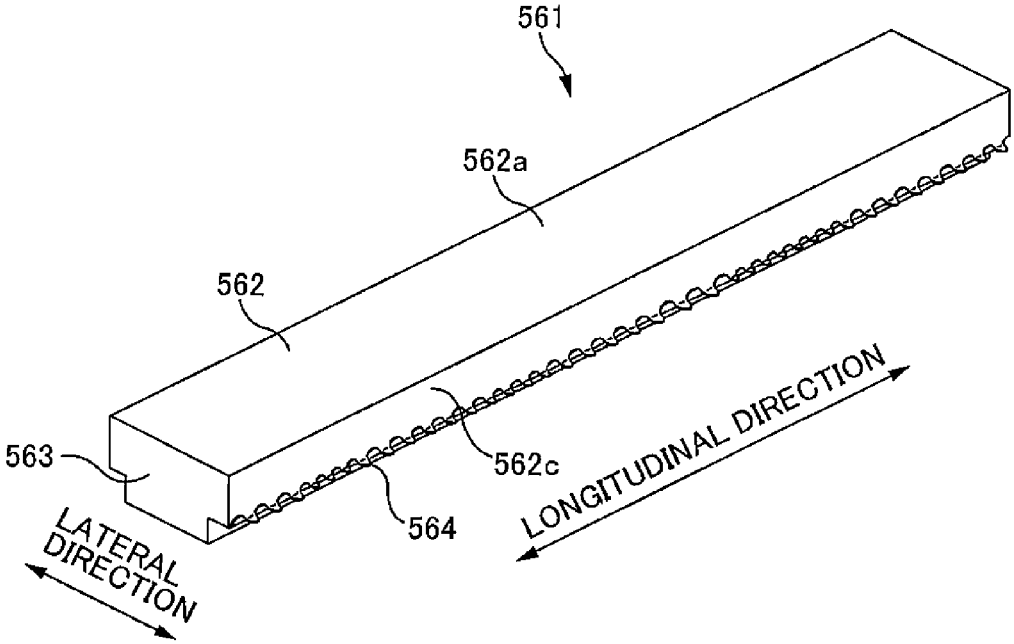
FIG. 7 is a perspective view of a rubber section 561 of the restriction blade 560 according to the first embodiment.
Figure 8:
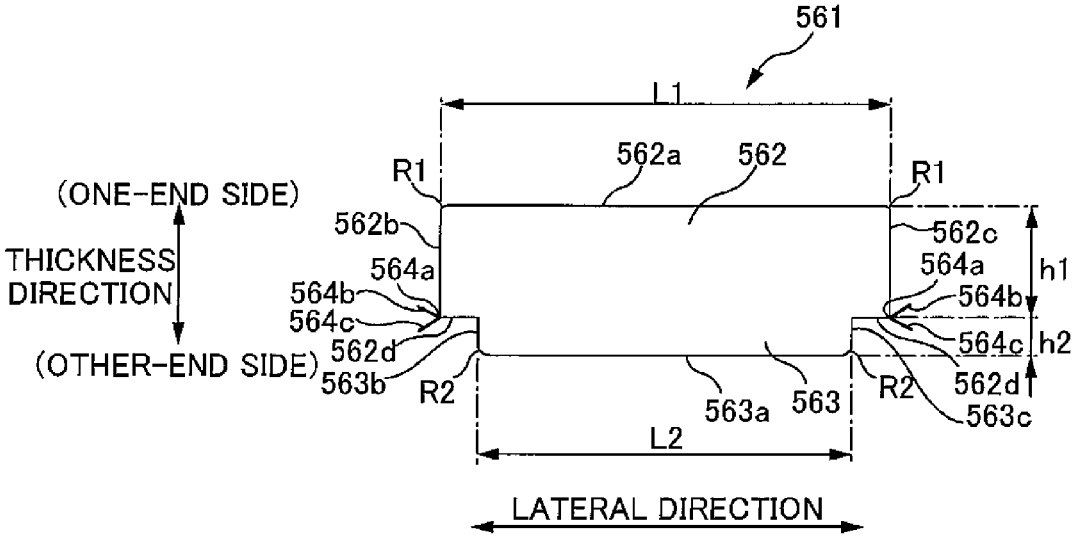
FIG. 8 is a cross-sectional view of the rubber section 561 according to the first embodiment.

Next, a configuration example of the restriction blade 560 is described with reference to FIGS. 4 through 8. FIG. 5 is a diagram showing a state in which the restriction blade 560 abuts against the developing roller 510. FIG. 6 is an explanatory diagram showing the configuration of the restriction blade 560. FIG. 7 is a perspective view of the rubber section 561 of the restriction blade 560. FIG. 8 is a cross-sectional view of the rubber section 561 and shows a cross-section of the rubber section 561 when cut by a plane perpendicular to the longitudinal direction shown in FIG. 7. Note that, the arrow in FIG. 5 indicates the up-and-down direction, the arrows in FIGS. 6 and 7 indicate the longitudinal direction and a transverse direction of the rubber section 561, and the arrows in FIG. 8 indicate the transverse direction and a thickness direction of the rubber section 561, respectively.

The restriction blade 560 includes the rubber section 561 and the rubber-supporting section 566, and is provided such that the restriction blade 560 is along the developing roller 510 from one end side to the other end side in an axial direction of the developing roller 510. The restriction blade 560 restricts a layer thickness of toner T borne by the developing roller 510 by abutting against the developing roller 510, and also charges electrically the toner T borne by the developing roller 510.

Figure 20A:
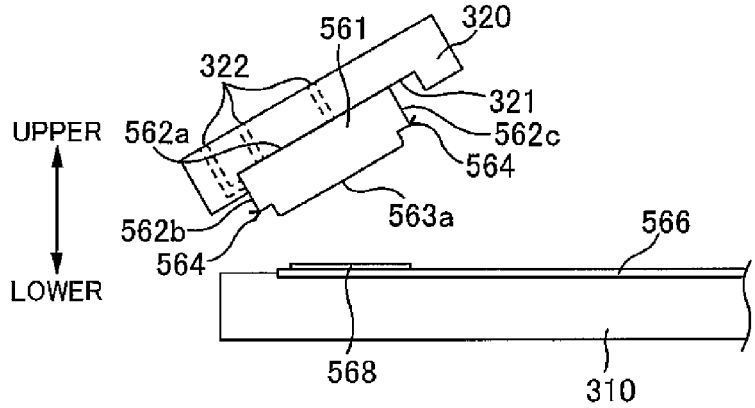
FIG. 20A is a diagram for describing a state in which the rubber section 561 according to the first embodiment and the rubber-supporting section 566 are held.

The rubber section 561 is an abutting member that abuts against the developing roller 510 at an abutting surface 562*a*, and is for restricting a layer thickness of toner borne by the developing roller 510. The rubber section 561 abuts against the developing roller 510 such that the longitudinal direction of the rubber section 561 is along the axial direction of the developing roller 510. Besides, an adhering surface 563*a* of the rubber section 561, which is an example of a non-abutting surface located an opposite side from the abutting surface 562*a* in the thickness direction, adheres to the rubber-supporting section 566 with a double-sided adhesive tape 568 (FIG. 20A).

The rubber section 561 in this embodiment is made of thermoplastic elastomer (specifically, ether-based thermoplastic elastomer) (note that the rubber section 561 is made of thermoplastic elastomer, and strictly speaking the thermoplastic elastomer is different from rubber. However, in this example, the member indicated by the numerical reference 561 is referred to as the rubber section 561 for the sake of convenience).

Further, as shown in FIG. 8, the rubber section 561 includes a long-side section 562 whose length in the transverse direction is long and a short-side section 563 whose length in the transverse direction is short. The long-side section 562 is a first portion that includes the abutting surface 562*a* and that is located on a one-end side in the thickness direction. The short-side section 563 is a second portion that includes the adhering surface 563*a* and that is located on an other-end side in the thickness direction and is connected to the long-side section 562.

Here, the long-side section 562 includes four surfaces that are along the longitudinal direction of the rubber section 561, namely, the above-mentioned abutting surface 562*a*, a front surface 562*b* that is located on a front end of the restriction blade 560 in the transverse direction, a rear surface 562*c* that is located on an opposite side from the front surface 562*b*, and an end surface 562*d* that is located on the opposite side from the abutting surface 562*a*. The short-side section 563 includes three surfaces that are along the longitudinal direction, namely, the above-mentioned adhering surface 563*a*, an end surface 563*b* that is located on a front end of the restriction blade 560 in the transverse direction, and an end surface 563*c* that is located on an opposite side from the end surface 563*b*.

As shown in FIG. 8, a length L1 of the long-side section 562 in the transverse direction of the rubber section 561 (6 mm in this embodiment) is larger than a length L2 of the short-side section 563 in this transverse direction (5 mm in this embodiment). Besides, a length h1 of the long-side section 562 in the thickness direction (1.5 mm in this embodiment) is larger than a length h2 of the short-side section 563 in the thickness direction (0.5 mm). Further, the abutting surface 562*a* of the long-side section 562 has a curve R1 (which is also referred to as a first curve) formed on an edge of the abutting surface 562*a*, and the adhering surface 563*a* of the short-side section 563 has a curve R2 (which is also referred to as a second curve) formed on an edge of the adhering surface 563*a*. A radius of curvature of the curve R1 (approximately 0.2 mm in this embodiment) is smaller than a radius of curvature of the curve R2 (approximately 1.0 mm in this embodiment). Furthermore, a ten-point average height of irregularities Rz of the abutting surface 562*a* is smaller than a ten-point average height of irregularities Rz of the adhering surface 563*a*. In this embodiment, the abutting surface 562*a* is molded such that its ten-point average height of irregularities Rz is equal to or more than 0.2 μm and is less than 5 μm, and the adhering surface 563*a* is molded such that its ten-point average height of irregularities Rz is equal to or more than 5 μm and is less than 15 μm. Note that the above-mentioned lengths L1, L2, h1, h2, the sizes of the curves R1, R2, and the values of the ten-point average heights of irregularities Rz are each merely an example, and the lengths, the sizes, and the values are not limited thereto.

By the way, the rubber section 561 is a molded article that is molded by injection molding (to be described in detail later). On this rubber section 561 that is molded by injection molding, a flash, which is an unnecessary section, is created. Also, in this embodiment, on the developing devices 51, 52, 53, 54 that are constructed with the rubber section 561 being used as a component, some of flashes 564 remains, as shown in FIG. 5.

Here, the flash 564 is described in detail. As shown in FIG. 8, the flash 564 remains and its base 564*a* is located on an edge of the end surface 562*d* of the long-side section 562 (this edge is also an edge of the front surface 562*b* and the rear surface 562*c*). As shown in FIG. 7, the base 564*a* is located on the edge of the end surface 562*d* along the longitudinal direction of the rubber section 561, while being located from a one end to another end in the longitudinal direction of the rubber section 561. The flash 564 includes a flash 564*b* whose edge is located on a side close to the abutting surface 562*a* with respect to the base 564*a* in the thickness direction, and a flash 564*c* whose edge is located on a side close to the adhering surface 563*a* with respect to the base 564*a* in the thickness direction. These flashes 564*b*, 564*c* are all located between the abutting surface 562*a* and the adhering surface 563*a* in the thickness direction. None of the flashes 564 is in contact with the rubber-supporting section 566, as shown in FIG. 5. Further, because the length h1 of the long-side section 562 in the thickness direction is larger than the length h2 of the short-side section 563 in the thickness direction as mentioned above, the flash 564 is located on the side close to the adhering surface 563*a* in the thickness direction.

Figure 18:
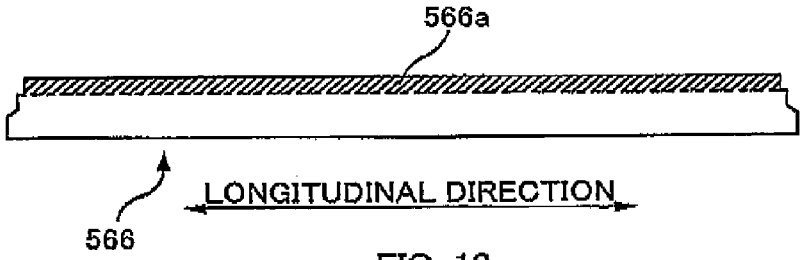
FIG. 18 is a diagram showing an adhering surface 566*a* of a rubber-supporting section 566 according to the first embodiment.

The rubber-supporting section 566 is a thin metal plate that is made of phosphor bronze, stainless steel, etc. and that has a spring-like characteristic. The rubber-supporting section 566 has the rubber section 561 that adheres thereto with the double-sided adhesive tape 568 existing between the adhering surface 563*a* of the rubber section 561 and an adhering surface 566*a* of the rubber-supporting section 566, the adhering surface 566*a* adhering to the rubber section 561 (FIG. 18). Further, the rubber-supporting section 566 is mounted on the housing 540 via the blade-supporting metal plate 567 with a one end section of the rubber-supporting section 566 being supported by a blade-supporting metal plate 567 (FIG. 4). Further, a blade back member 570 made of Moltoprene, etc. is provided on the restriction blade 560 on a side opposite from a side close to the developing roller 510.

Here, the rubber section 561 is pressed against the developing roller 510 by elastic force that is due to bending of the rubber-supporting section 566. Further, the blade back member 570 prevents toner T from entering between the rubber-supporting section 566 and the housing 540, and stabilizes elastic force that is due to bending of the rubber-supporting section 566. In addition thereto, the blade back member 570 presses the rubber section 561 against the developing roller 510 by urging the rubber section 561 from the back of the rubber section 561 toward the developing roller 510. Accordingly, the blade back member 570 makes the rubber section 561 abut more evenly against the developing roller 510.

An end, of the restriction blade 560, that is located on an opposite side from an end supported by the blade-supporting metal plate 567, that is, an edge (a one end of the abutting surface 562*a* in the transverse direction of the rubber section 561) is not in contact with the developing roller 510, as shown in FIG. 5, but a section located at a predetermined distance from the edge is in contact with the developing roller 510 over a certain width. In other words, the restriction blade 560 (the rubber section 561) does not abut at the edge thereof, but abuts in surface-to-surface contact, against the developing roller 510. Besides, the restriction blade 560 (the rubber section 561) is arranged such that its edge (the one end of the abutting surface 562*a* in the transverse direction of the rubber section 561) points toward the upstream side of the rotating direction of the developing roller 510, and makes a so-called counter-abutment with respect to the developing roller 510. Note that the abutting position at which the restriction blade 560 (the rubber section 561) abuts against the developing roller 510 is located lower than the central axis of the developing roller 510, and is lower than a central axis of the toner supply roller 550.

Figure 9:
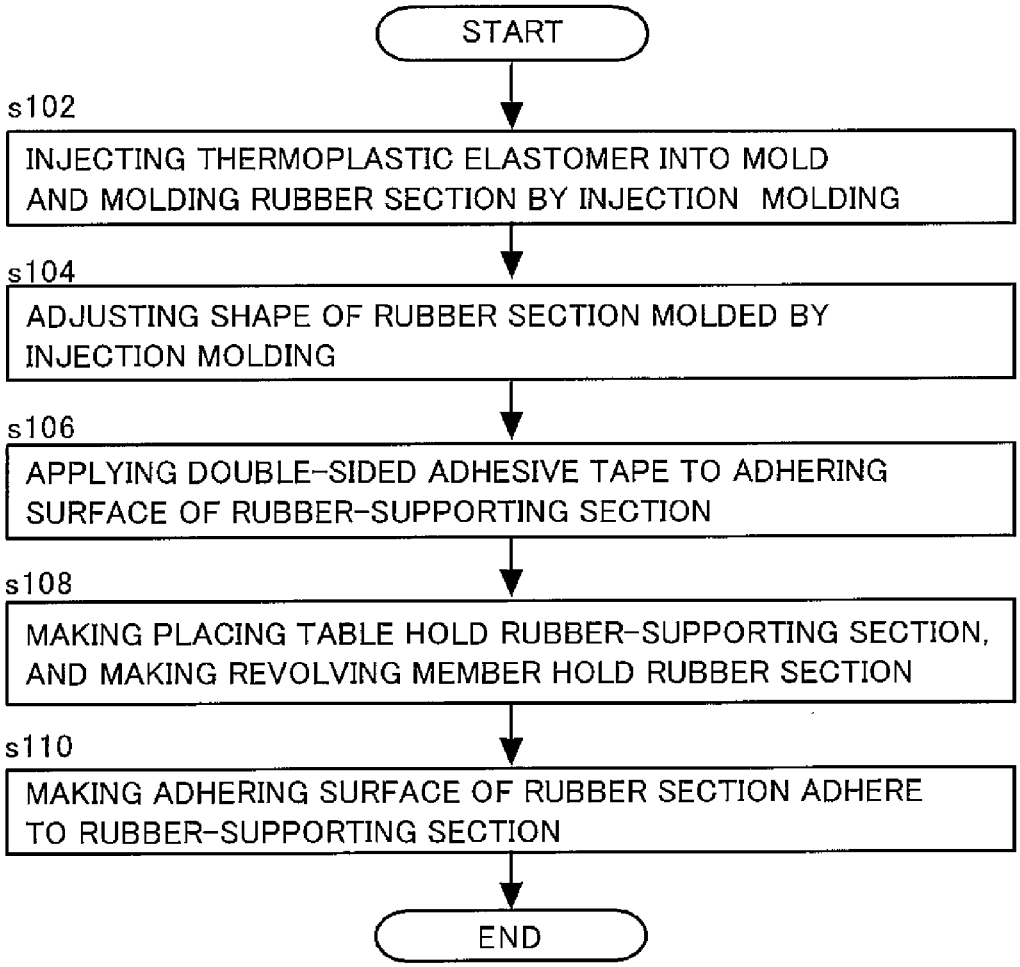
FIG. 9 is a flowchart showing manufacturing processes of the restriction blade 560 according to the first embodiment.
Figure 10:
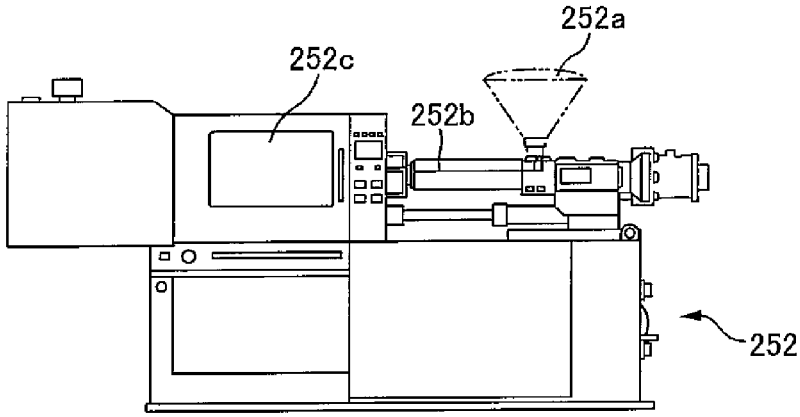
FIG. 10 is a schematic diagram showing an example of an injection molding machine 252 according to the first embodiment.
Figure 11:
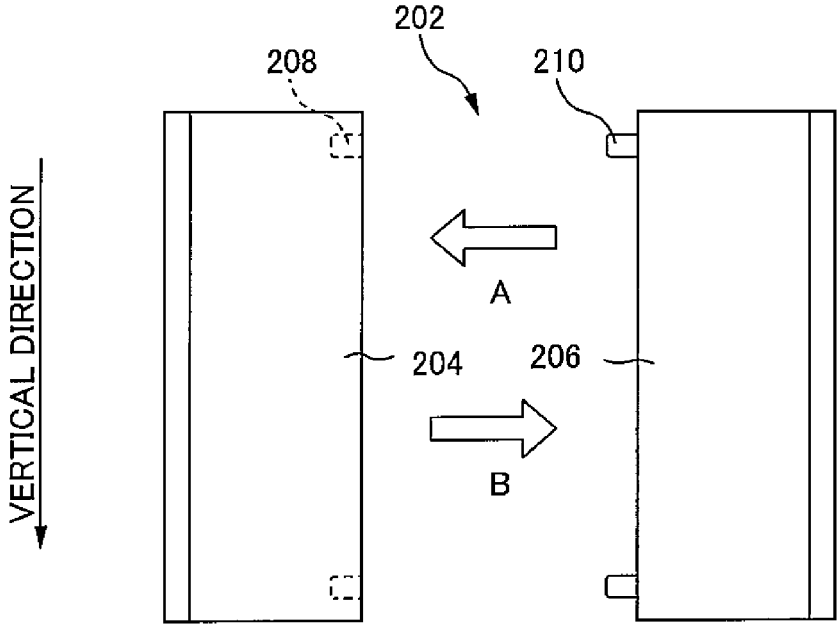
FIG. 11 are schematic diagrams showing an external structure of a mold 202 according to the first embodiment.
Figure 12:
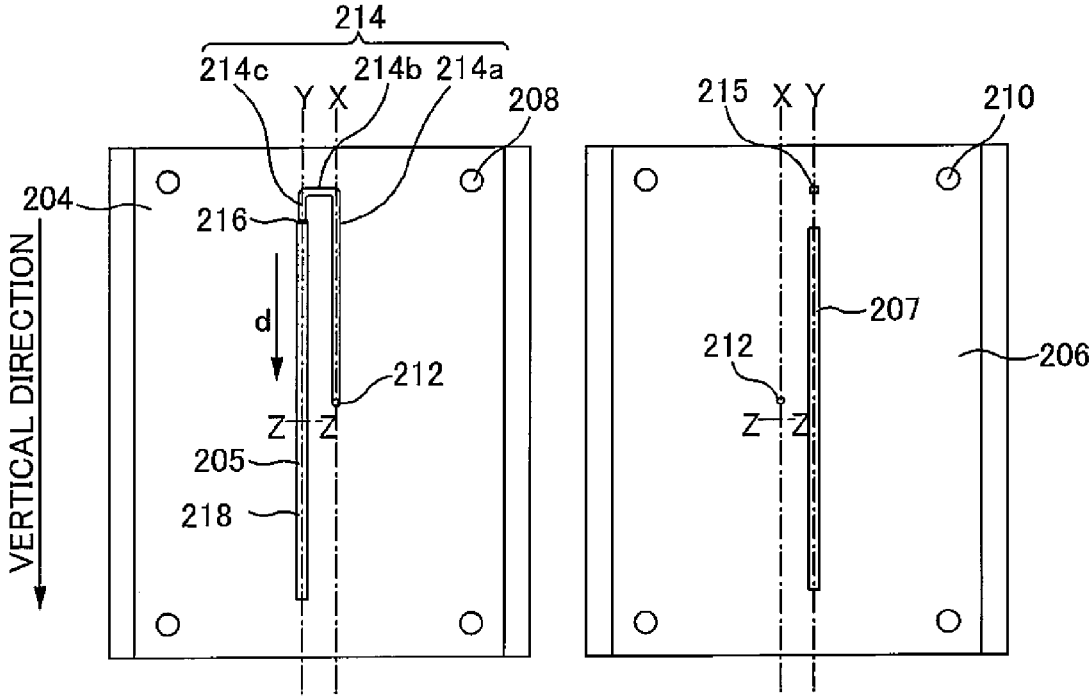
FIG. 12 are schematic diagrams showing an internal structure of the mold 202 according to the first embodiment.
Figure 13:
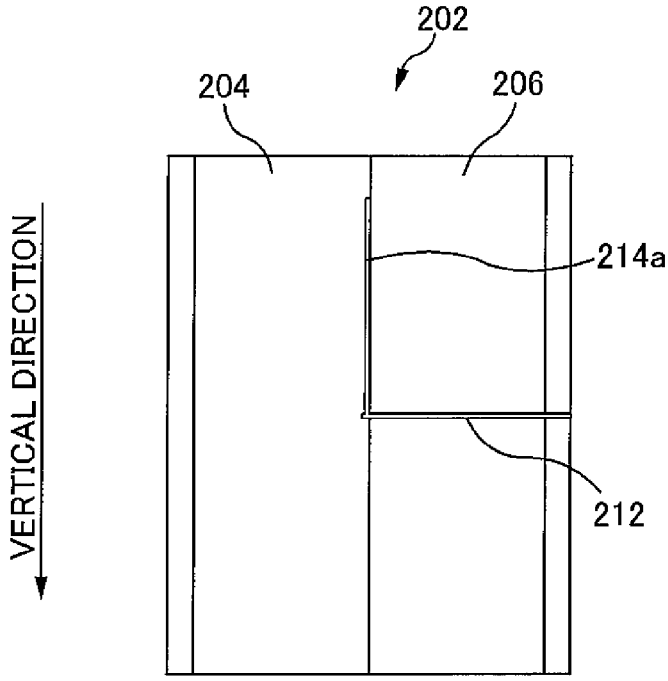
FIG. 13 is a schematic diagram showing the X-X cross-section of FIG. 12.
Figure 14:
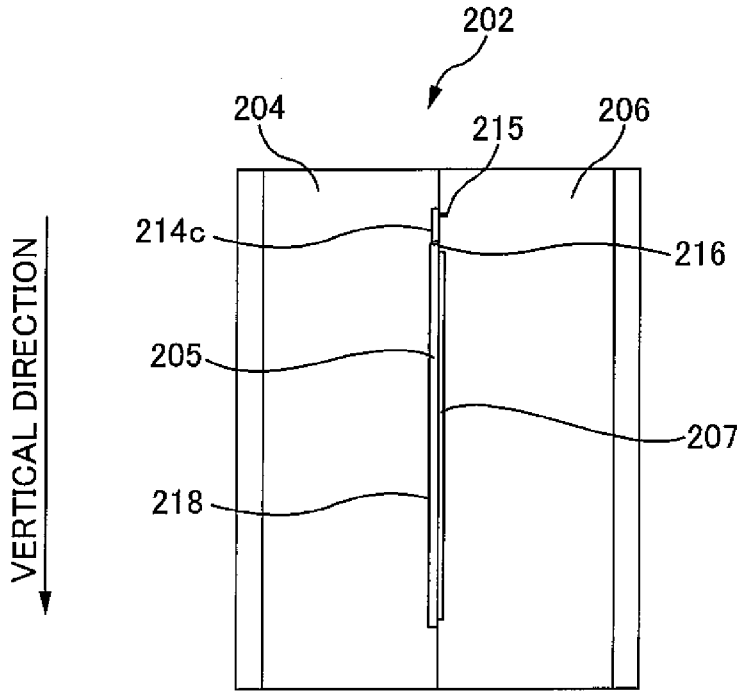
FIG. 14 is a schematic diagram showing the Y-Y cross-section of FIG. 12.
Figure 15:
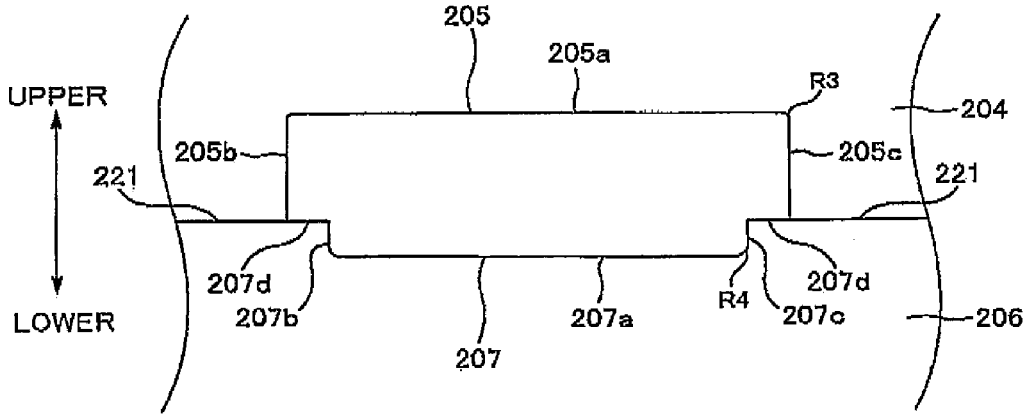
FIG. 15 is a schematic diagram showing the Z-Z cross-section of FIG. 12.
Figure 16:
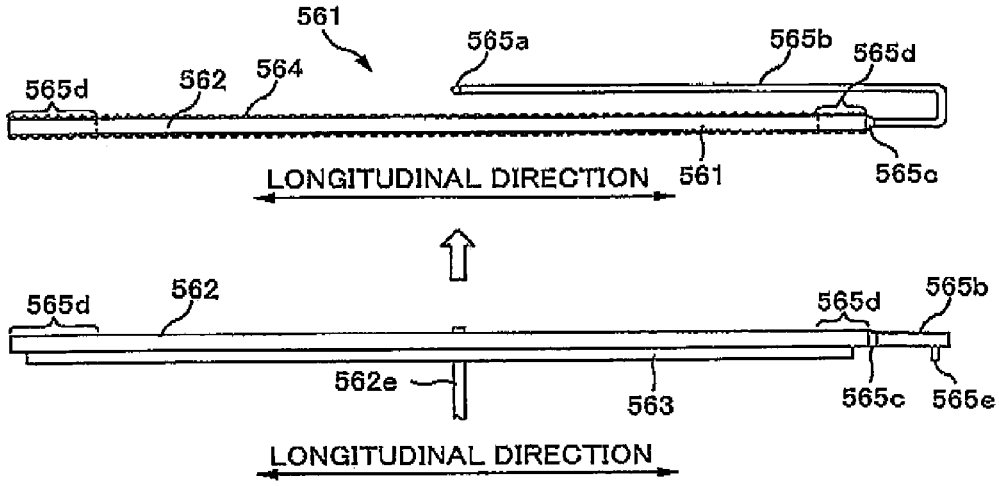
FIG. 16 are diagrams showing the rubber section 561 according to the first embodiment that is molded.
Figure 17:
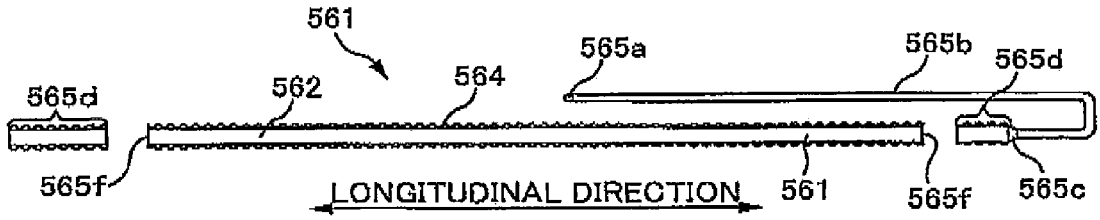
FIG. 17 is a schematic diagram showing how a surplus section 565*d*, a handle section 565*e*, etc. are cut and removed from the rubber section 561 according to the first embodiment.
Figure 19:
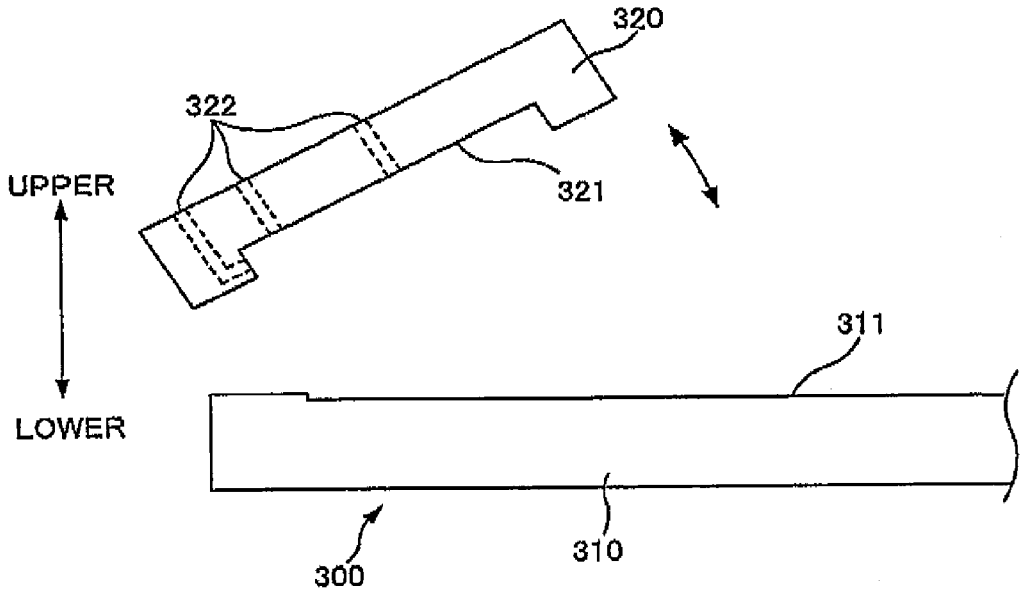
FIG. 19 is a schematic diagram showing an adhering jig 300 according to the first embodiment.
Figure 20B:
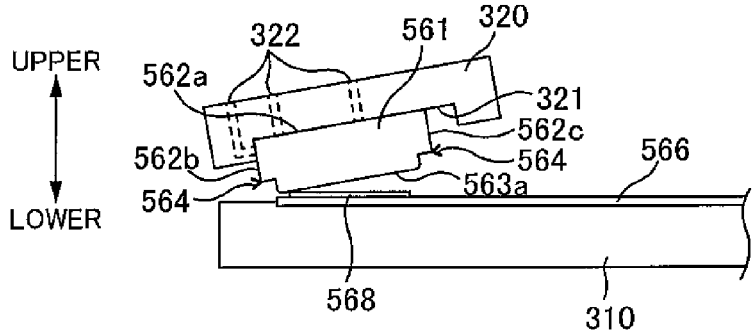
FIG. 20B is a diagram for describing a state in which the rubber section 561 according to the first embodiment starts adhering to the rubber-supporting section 566.
Figure 20C:
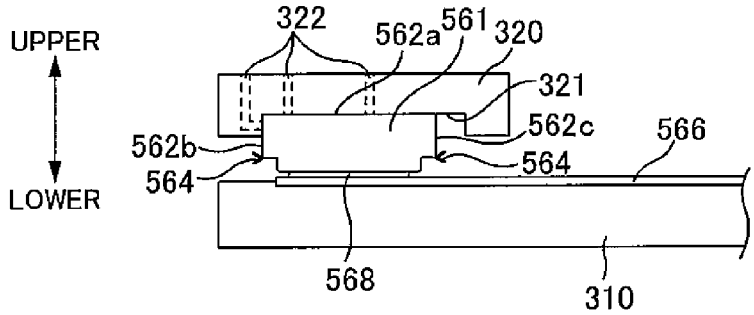
FIG. 20C is a diagram for describing a state in which the rubber section 561 according to the first embodiment is pressed in contact with the rubber-supporting section 566.
Figure 20D:
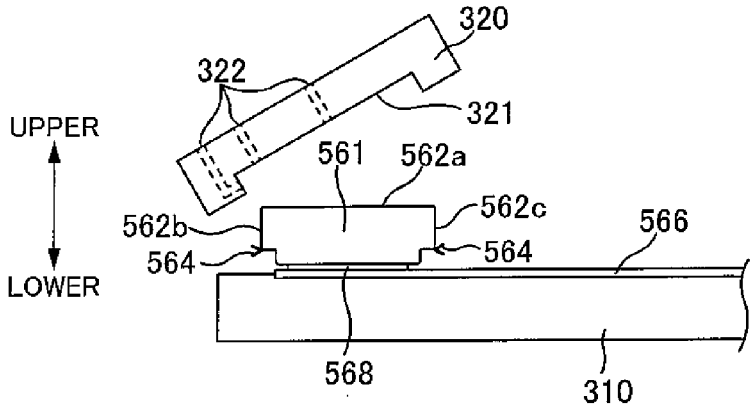
FIG. 20D is a diagram for describing a state when a process of making the rubber section 561 according to the first embodiment adhere to the rubber-supporting section 566 is completed.

Regarding Method for Manufacturing Restriction Blade According to First Embodiment Here, a method for manufacturing the restriction blade 560 according to the first embodiment is described with reference to FIGS. 9 through 19, 20A through 20D. FIG. 9 is a flowchart showing manufacturing processes of the restriction blade 560. FIG. 10 is a schematic diagram showing an example of an injection molding machine 252. FIG. 11 are schematic diagrams showing an external structure of a mold 202. FIG. 12 are schematic diagrams showing an internal structure of the mold 202. FIG. 13 is a schematic diagram showing the X-X cross-section of FIG. 12. FIG. 14 is a schematic diagram showing the Y-Y cross-section of FIG. 12. FIG. 15 is a schematic diagram showing the Z-Z cross-section of FIG. 12. FIG. 16 are diagrams showing the rubber section 561 that is molded. FIG. 17 is a schematic diagram showing how a surplus section 565*d,* a handle section 565*e,* etc. are cut and removed from the rubber section 561. FIG. 18 is a diagram showing the adhering surface 566*a* of the rubber-supporting, section 566. FIG. 19 is a schematic diagram showing an adhering jig 300. FIG. 20A is a diagram for describing a state in which the rubber section 561 and the rubber-supporting section 566 are held. FIG. 20B is a diagram for describing a state in which the rubber section 561 starts adhering to the rubber-supporting section 566. FIG. 20C is a diagram for describing a state in which the rubber section 561 is pressed in contact with the rubber-supporting section 566. FIG. 20D is a diagram for describing a state when a process of making the rubber section 561 adhere to the rubber-supporting section 566 is completed.

Note that the left diagram of FIG. 12 shows the left diagram of FIG. 11 viewed in a direction of the white arrow labeled with symbol A in FIG. 11. In the same way, the right diagram of FIG. 12 shows the right diagram of FIG. 11 viewed in a direction of the white arrow labeled with symbol B in FIG. 11. The lower diagram of FIG. 16 shows the upper diagram of FIG. 16 viewed in a direction of the white arrow. FIG. 11 shows a state in which the mold 202 is opened, and FIGS. 13 through 15 shows a state in which the mold 202 is closed. In FIGS. 11 through 14, the vertical direction is indicated by the arrow.

First, the rubber section 561 of the restriction blade 560 is molded by injection-molding with an injection molding apparatus (an apparatus including the injection molding machine 252 and the mold 202, which is an example of a blade-forming mold (which is also merely referred to as a mold), is referred to as an injection molding apparatus in this embodiment) (step S102). More specifically, the rubber section 561 is molded by injection molding by injecting molten thermoplastic elastomer into the mold 202 from the injection molding machine 252 shown in FIG. 10.

The thermoplastic elastomer is loaded into a hopper section 252*a* of the injection molding machine 252, and the loaded thermoplastic elastomer is heated and becomes molten in an injection barrel 252*b*. Then, the thermoplastic elastomer that is heated and becomes molten is injected into the mold 202 that is mounted on a mold-mounting section 252*c* of the injection molding machine 252. The thermoplastic elastomer that is injected into the mold 202 passes through a sprue 212 which is an opening for receiving of the thermoplastic elastomer injected by the injection molding machine 252, passes through a runner 214 which is a channel for leading the thermoplastic elastomer from the sprue to a gate, and passes through the gate 216 which is an entrance of a cavity 218. And, the thermoplastic elastomer fills the cavity 218 in the mold 202. A temperature of the mold 202 is kept at a temperature lower than a temperature of the thermoplastic elastomer, and the thermoplastic elastomer in the mold 202 is cooled by the mold 202 so that the rubber section 561 is molded.

Here, the structure of the above-mentioned mold 202 and a shape of the rubber section 561 that is molded by the mold 202 are described with reference to FIGS. 11 through 16.

The mold 202 includes two mold portions: a stationary mold portion 204 that is an example of a first mold that includes an abutting-surface forming section for forming the abutting surface 562*a,* and a movable mold portion 206 that is an example of a second mold that includes an adhering-surface forming section for forming the adhering surface 563*a* and that is movable relative to the stationary mold portion 204. As shown in FIG. 11, the stationary mold portion 204 has guide bushes 208, and the movable mold portion 206 has guide pins 210, respectively. When the mold 202 is closed, the guide pins 210 are fitted into the guide bushes 208, so that positions of the stationary mold portion 204 and the movable mold portion 206 relative to each other are positioned accurately.

Besides, the mold 202 is furnished with the sprue 212, the runner 214, the gate 216, and the cavity 218, as mentioned above.

The sprue 212 is mainly provided in the movable mold portion 206 as shown in FIG. 13, and an entrance of the sprue 212 is located on a surface, of the movable mold portion, that is located on an opposite side from the stationary mold portion 204. The sprue 212 penetrates the movable mold portion 206 from the entrance, and reaches the stationary mold portion 204. The sprue 212 is adjacent to the runner 214 on the stationary mold portion 204.

The runner 214 is provided in the stationary mold portion 204, and includes a first channel 214*a* that is adjacent to the sprue 212, a second channel 214*b* that is adjacent to the first channel 214*a,* and a third channel 214*c* that is adjacent to the second channel 214*b* and reaches the gate 216. As shown in the left diagram of FIG. 12, the first channel 214*a* and the third channel 214*c* are provided along the vertical direction, and the second channel 214*b* is provided along a direction perpendicular to the vertical direction. As shown in FIG. 14, a handle-molding section 215 for molding the handle section 565*e* is provided in a position, of the movable mold portion 206, which opposes the third channel 214*c*.

As shown in the left diagram of FIG. 12 and FIG. 14, the gate 216 is provided in an upper section of the stationary mold portion 204 in the vertical direction, and is adjacent to the third channel 214*c* of the runner 214 and the cavity 218.

As shown in the left diagram of FIG. 12 and FIG. 14, the cavity 218 is provided in a section that is lower in the vertical direction with respect to the gate 216, and is adjacent to the gate 216. The longitudinal direction of the cavity 218 is along the vertical direction. As shown in FIG. 15, the stationary mold portion 204 is furnished with a stationary-mold recess 205 that is an example of a first depression and whose bottom surface is an abutting-surface forming section 205*a* for forming the abutting surface 562*a* of the long-side section 562; and the movable mold portion 206 is furnished with a movable-mold recess 207 that is an example of a second depression and whose bottom surface is an adhering-surface forming section 207*a* for forming the adhering surface 563*a* of the short-side section 563.

As shown in FIG. 15, the stationary-mold recess 205 includes the above-mentioned abutting-surface forming section 205*a,* a front-surface forming section 205*b* that is for forming the front surface 562*b,* and a rear-surface forming section 205*c* that is for forming the rear surface 562*c*. The movable-mold recess 207 includes the above-mentioned adhering-surface forming section 207*a*, an end-surface forming section 207*b* that is for forming the end surface 563*b* of the short-side section 563, an end-surface forming section 207*c* that is for forming the end surface 563*c* of the short-side section 563, and an end-surface forming section 207*d* that is for forming the end surface 562*d* of the long-side section 562. The cavity 218 consists of these forming sections provided in the stationary-mold recess 205 and the movable-mold recess 207.

For the purpose of molding the rubber section 561 shown in FIG. 8, the stationary-mold recess 205 and the movable-mold recess 207 have the following shapes. That is, a depth of stationary-mold recess 205 is larger than a depth of the movable-mold recess 207, and a width of the stationary-mold recess 205 in the transverse direction is larger than a width of the movable-mold recess 207 in the transverse direction. Besides, curves R3, R4 are respectively formed on a corner of each of the stationary-mold recess 205 and the movable-mold recess 207; a radius of curvature of the curve R3 of the stationary-mold recess 205 is smaller than a radius of curvature of the curve R4 of the movable-mold recess 207. Further, a ten-point average height of irregularities Rz of the abutting-surface forming section 205*a* is smaller than a ten-point average height of irregularities Rz of the adhering-surface forming section 207*a*.

In a state in which the stationary mold portion 204 and the movable mold portion 206 that are both configured as mentioned above overlap (a state in which the mold 202 is closed), the thermoplastic elastomer is injected into the stationary-mold recess 205 and the movable-mold recess 207, and the rubber section 561 is molded by injection-molding. At this stage, when the stationary mold portion 204 and the movable mold portion 206 overlap, the boundary surface 221 between the stationary mold portion 204 and the movable mold portion 206 is located between the abutting-surface forming section 205*a* and the adhering-surface forming section 207*a* (between the stationary-mold recess 205 and the movable-mold recess 207) in a direction from the abutting-surface forming section 205*a* toward the adhering-surface forming section 207*a* (the up-and-down direction shown in FIG. 15). And, when injection-molding, the thermoplastic elastomer is injected in a direction along a longitudinal direction of the cavity 218, in other words, in a direction along a longitudinal direction of the above-mentioned forming sections (the direction is indicated by the arrow d in FIG. 12).

The rubber section 561 molded by the above-mentioned mold 202 has the shape shown in FIG. 16. Unlike a rubber section 561 of the restriction blade 560 that is provided on the developing device after manufacturing processes are completed (FIG. 6), the rubber section 561 that is molded includes a section molded by the sprue 212 (the section in this embodiment is referred to as a sprue section 565*a*), a section molded by the runner 214 (the section in this embodiment is referred to as a runner section 565*b*), and a section molded by the gate 216 (the section in this embodiment is referred to as a gate section 565*c*).

Further, a longitudinal-direction length of a section that is included the above-mentioned rubber section 561 and that is molded by the cavity 218 is larger than a longitudinal-direction length of the rubber section 561 of the restriction blade 560 that is provided on the developing device after manufacturing processes are completed (FIG. 6). More specifically, the shape of the above-mentioned mold 202 is decided such that, when molding the rubber section 561, the rubber section 561 includes the surplus section 565*d* on both end sections in the longitudinal direction of the rubber section 561. And, in a step to be described later (step S104), the molded surplus section 565*d* is cut and removed from the rubber section 561 together with the sprue section 565*a*, the runner section 565*b*, and the gate section 565*c*.

Further, the molded rubber section 561 is furnished with the handle section 565*e* at a position that is on an end section in the longitudinal direction and that is adjacent to the runner section 565*b*. This handle section 565*e* is for being grasped when taking out the molded rubber section 561 from the mold 202. The handle section 565*e* extends from the end section in the longitudinal direction, and its extending direction intersects the longitudinal direction of the rubber section 561. Note that, in a step to be described later (step S104), the handle section 565*e* is also cut and removed from the rubber section 561 together with the sprue section 565*a*, the runner section 565*b*, the gate section 565*c*, and the surplus section 565*d*.

By the way, a flash is created on the rubber section 561 that is molded by injection molding, and it is caused by the following reason. That is, if a pressure at which thermoplastic elastomer is injected into the mold 202 is large, the stationary mold portion 204 and the movable mold portion 206 deform. As a result thereof, there are cases in which a gap exists in the vicinity of the cavity 218 (specifically, the boundary surface 221). The injected thermoplastic elastomer fills not only the cavity 218 but also this gap, so that a flash is created.

Here, returning to the flowchart of FIG. 9, the description of the method for manufacturing the restriction blade 560 is continued. When the thermoplastic elastomer is sufficiently cooled by the mold 202 (step S102), the movable mold portion 206 is moved so that the mold 202 is opened. Thereat, the molded rubber section 561 is taken out of the mold 202. More specifically, by grasping the handle section 565*e* in the opened mold 202, the rubber section 561 is taken out of the mold 202.

Next, as shown in FIG. 17, the shape of the rubber section 561 is adjusted by cutting the above-mentioned surplus section 565*d* together with the sprue section 565*a*, the runner section 565*b*, the gate section 565*c*, and the handle section 565*e*, from the rubber section 561 that is taken out, at a cutting section 565*f* that is both end sections of the rubber section 561 in the longitudinal direction (step S104). Next, the rubber-supporting section 566 for supporting the rubber section 561 that is molded by injection molding is prepared, and the double-sided adhesive tape 568 is applied to the adhering surface 566*a* of the rubber-supporting section 566 (the shaded area shown in FIG. 18) (step S106).

Next, the adhering jig 300 that is used when making the rubber section 561 adhere to the rubber-supporting section 566 at a desired position of the rubber-supporting section 566 is prepared. As shown in FIG. 19, the adhering jig 300 consists of a placing table 310 that is an example of a first jig, and a revolving member 320 that is as an example of a second jig. In order to make the rubber section 561 and the rubber-supporting section 566 adhere to each other, initially, the rubber-supporting section 566 to which the double-sided adhesive tape 568 is applied is held by the placing table 310, and the rubber section 561 that is molded by injection molding and whose shape is adjusted is held by the revolving member 320, as shown in FIG. 20A (step S108).

Here, a structure of the adhering jig 300 is described.

The placing table 310 holds the rubber-supporting section 566 that is fitted into and is placed in a depressed section 311, as shown in FIG. 20A, the depressed section 311 being formed in an approximately same shape of the rubber-supporting section 566. In a state in which the rubber-supporting section 566 is fitted into and is placed in the depressed section 311, the rubber-supporting section 566 is positioned immovably in the horizontal direction. Besides, the placing table 310 holds the rubber-supporting section 566 such that the double-sided adhesive tape 568 that is applied to the rubber-supporting section 566 projects from the depressed section 311.

The revolving member 320 is a member that can revolve forward and backward while positioning and holding the rubber section 561 with a depressed section 321. As shown in FIG. 20A, among the long-side section 562 and the short-side section 563 of the rubber section 561, only the long-side section 562 is in contact with the depressed section 321 (more specifically, the abutting surface 562*a* and the front surface 562*b* of the long-side section 562 are in contact with the depressed section 321). And, the rubber section 561 is positioned with respect to the revolving member 320, with the short-side section 563 projecting from the depressed section 321. Further, through holes 322 are provided on the revolving member 320 that holds the rubber section 561, at a position opposing the abutting surface 562*a* and at a position opposing the front surface 562*b*. The rubber section 561 is sucked by a not-shown vacuum pump, etc. through the through holes 322.

As mentioned above, sucking the rubber section 561 enables the rubber section 561 to be held by the revolving member 320 without falling, and positioning of the rubber section 561 with respect to the revolving member 320 is maintained. Note that, the revolving member 320 according to this embodiment is configured such that, in a state in which the rubber section 561 is held by the depressed section 321, the flash 564 is not in contact with the depressed section 321 while a section, of the front surface 562*b*, that is located on the side close to the abutting surface 562*a* is in contact with the depressed section 321.

Further, the revolving member 320 is connected to and is supported by the placing table 310 with a not-shown mechanism, in a state in which the revolving member 320 can revolve. Since the rubber section 561 is sucked when the revolving member 320 revolves, the rubber section 561 is held with respect to the revolving member 320 and its positioning is maintained when the revolving member 320 revolves.

With respect to the adhering jig 300 having the above-mentioned configuration, the rubber section 561 and the rubber-supporting section 566 are held in the following manner. That is, the rubber-supporting section 566 to which the double-sided adhesive tape 568 is applied is held by moving the rubber-supporting section 566 toward the depressed section 311 from above the placing table 310 in the up-and-down direction shown in FIG. 20A and fitting the rubber-supporting section 566 into the depressed section 311. And, the rubber section 561 that is molded by injection molding is moved toward the depressed section 321 from below the revolving member 320 in the up-and-down direction, and the rubber section 561 comes in contact with the depressed section 321. At this stage, when the rubber section 561 comes in contact with the depressed section 321, air inside the depressed section 321 is sucked by the vacuum pump through the through holes 322, and therefore, the rubber section 561 that is in contact with the depressed section 321 is sucked. The rubber section 561 is positioned and held because the abutting surface 562*a* and the front surface 562*b* are in contact with the depressed section 321 with the rubber section 561 being sucked. Note that, because the rubber section 561 is held by the revolving member 320 in a state in which a section, of the front surface 562*b*, that is located on the side close to the abutting surface 562*a* is in contact with the depressed section 321 as mentioned above, it is possible to make the revolving member 320 hold the rubber section 561 such that the flash 564 of the rubber section 561 that is molded by injection molding is not in contact with the revolving member 320.

Next, the revolving member 320 that holds the rubber section 561 is relatively moved closer to the placing table 310 that holds the rubber-supporting section 566 such that the adhering surface 563*a* of the rubber section 561 comes in contact with the rubber-supporting section 566, and the adhering surface 563*a* and the rubber-supporting section 566 adhere to each other (step S110).

Specifically, the adhering surface 563*a* and the rubber-supporting section 566 adhere to each other in the following manner. That is, when gradually revolving the revolving member 320 that holds the rubber section 561 at the position shown in FIG. 20A (hereinafter referred to as a "first position") such that the revolving member 320 becomes close to the placing table 310 that holds the rubber-supporting section 566, a one-end side of the adhering surface 563*a* in the transverse direction initially comes in contact with double-sided adhesive tape 568, as shown in FIG. 20B. And then, with further revolving of the revolving member 320, an area on which the adhering surface 563*a* is in contact with the double-sided adhesive tape 568 becomes larger. When the revolving member 320 revolves and reaches a predetermined position (hereinafter referred to as "second position"), the state shown in FIG. 20C occurs. Since the rubber section 561 is pressed in contact with the rubber-supporting section 566 in the state shown in FIG. 20C, the rubber section 561 and the rubber-supporting section 566 effectively adhere to each other via the double-sided adhesive tape 568. Note that, in this embodiment, as shown in FIGS. 20B and 20C, the adhering surface 563*a* of the rubber section 561 and the rubber-supporting section 566 adhere to each other such that the flash 564 does not adhere to the rubber-supporting section 566.

When the rubber section 561 and the rubber-supporting section 566 adhere to each other, the revolving member 320 located at the second position is revolved until it reaches the first position after suction with the vacuum pump is finished. Due to finishing of the suction, the rubber section 561 is not held by the revolving member 320. Therefore, as shown in FIG. 20D, the rubber-supporting section 566 to which the rubber section 561 adheres is a state in which it is placed on the placing table 310. When the revolving member 320 is located at the first position, the rubber-supporting section 566 to which the adhering surface 563*a* of the rubber section 561 adheres is taken out of the placing table 310. As a result thereof, it is possible to obtain the restriction blade 560 in which the adhering surface 563*a* is appropriately held by the rubber-supporting section 566. Assembling the restriction blade 560 manufactured in the above-mentioned manner together with the developing roller 510, etc. enables to obtain the developing device shown in FIG. 4.

Regarding Effectiveness of Restriction Blade 560, etc. According to First Embodiment As mentioned above, in the restriction blade 560 according to this embodiment, the flash 564 of the layer-thickness restriction member (the rubber section 561) is located on the side close to the non-abutting surface (the adhering surface 563*a*) that is located on the opposite side from the abutting surface 562*a* in the thickness direction of the rubber section 561. As a result thereof, a layer thickness of toner borne by the developing roller 510 is restricted evenly. This is described hereinbelow in greater detail.

As mentioned above, it is desirable that a layer thickness of toner restricted by the rubber section 561 be even. The reason is because, if a layer thickness of toner is uneven, there are cases in which, for example, streaks, etc. appear in a toner image developed by the developing roller 510, and the quality of the toner image deteriorates.

By the way, the rubber section 561 is a molded article, and, for example, there are cases in which a flash is created on the rubber section 561 in the above-mentioned injection molding. It can be considered to remove the created flash, but there are cases in which the flash is not removed in view of simplifying processes for manufacturing the rubber section 561. However, if the flash is not removed, when the flash is located close to the developing roller 510, there is a possibility in which the rubber section 561 restricts unevenly a layer thickness of toner borne by the developing roller 510.

This is described more specifically with respect to FIG. 5. The rubber section 561 restricts a layer thickness of toner that is brought into a gap between the rubber section 561 and the developing roller 510 (a gap A shown in FIG. 5), and that passes through the abutting position of the rubber section 561 with rotation of the developing roller 510. It is known that a layer thickness of toner depends on an amount of toner that is brought into the gap A (hereinafter referred to as "an amount of brought-in toner"). For example, if an amount of brought-in toner into the gap A is uneven in the axial direction of the developing roller 510 (in the same direction as the longitudinal direction of the rubber section 561), an amount of toner borne by the developing roller 510 at the gap A becomes uneven in the axial direction. As a result thereof, a layer thickness of toner on the developing roller 510 also becomes uneven in the axial direction.

In this case, if the flash 564 is located on the side close to the abutting surface 562*a* in the thickness direction of the rubber section 561 (for example, the flash 564 is located on the abutting surface 562*a*, or the flash 564 is located, on the front surface 562*b*, on the side close to the abutting surface 562*a*), the flash 564 becomes an obstruction to movement of toner when bringing toner into the gap A. Therefore, the amount of brought-in toner is likely to be uneven in the axial direction of the developing roller 510. If the amount of brought-in toner is uneven, a layer thickness of toner that is restricted by the rubber section 561 at the abutting position also becomes uneven.

On the other hand, if, as mentioned in this embodiment shown in FIG. 8, the flash 564 of the rubber section 561 is located on the side close to the adhering surface 563*a* that is located on the opposite side from the abutting surface 562*a* in the thickness direction, the flash 564 is difficult to become the obstruction to movement of toner and does not adversely affect bringing of toner into the gap A. Therefore, the restriction blade 560 according to this embodiment enables to prevent an amount of brought-in toner from being uneven in the axial direction of the developing roller 510. As a result thereof, a layer thickness of toner borne by the developing roller 510 is restricted evenly.

Besides, as mentioned above, a method for manufacturing the restriction blade 560 according to the first embodiment includes, as shown in FIG. 9, a step for molding by injection molding the rubber section 561 by injecting thermoplastic elastomer into a mold (the mold 202) that includes a first mold (the stationary mold portion 204) that includes the abutting-surface forming section 205*a* for forming the abutting surface 562*a* of the rubber section 561, and a second mold (the movable mold portion 206) that includes the adhering-surface forming section 207*a* for forming the adhering surface 563*a* and that is movable relative to the stationary mold portion 204, wherein the stationary mold portion 204 and the movable mold portion 206 overlap such that the boundary surface 221 between the stationary mold portion 204 and the movable mold portion 206 is located between these two molds, in the direction from the abutting-surface forming section 205*a* toward the adhering-surface forming section 207*a*, and a step for making the adhering surface 563*a* of the rubber section 561 that is molded by injection molding and a supporting member (the rubber-supporting section 566) adhere to each other. This increases the precision of the restriction blade 560 that is manufactured. This is described hereinbelow in greater detail.

As mentioned above, as a method for manufacturing the restriction blade 560, there is known a method for obtaining the restriction blade 560 in which the rubber section 561 and the rubber-supporting section 566 are separately molded or formed in any other way and the adhering surface 563*a* of the molded rubber section 561 and the rubber-supporting section 566 adheres to each other. And, there are cases of employing, as a method for molding the rubber section 561, a method for molding the rubber section 561 by injection molding by injecting material of the rubber section 561 (thermoplastic elastomer) into a mold that includes a first mold that includes an abutting-surface forming section for forming the abutting surface 562*a*, and a second mold that includes an adhering-surface forming section for forming the adhering surface 563*a* and that is movable relative to the first mold.

By the way, if the rubber section 561 is molded by injection molding, the flash 564 is likely to be created on a section of the boundary surface between the first mold and the second mold when molding the rubber section by injection molding. If the rubber-supporting section 566 and the adhering surface 563*a*, of the rubber section 561, on which the flash 564 is created adhere to each other, there are cases in which the adhering surface 563*a* does not adhere to the rubber-supporting section 566 properly.

Figure 21:
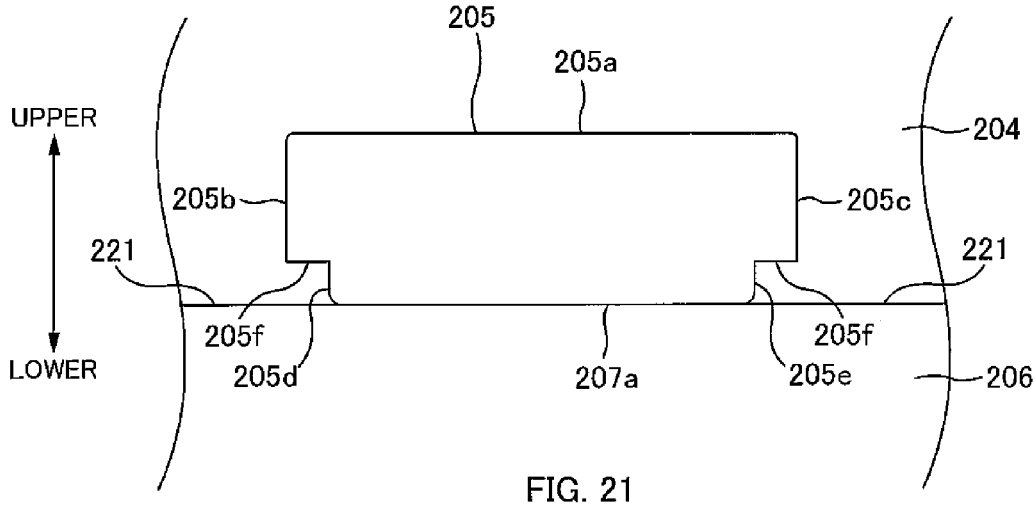
FIG. 21 is a diagram for describing a comparison example according to the first embodiment.

This is described in detail with reference to a comparison example shown in FIG. 21. As shown in FIG. 21, the stationary mold portion 204 according to the comparison example has the abutting-surface forming section 205*a*, the front-surface forming section 205*b*, and the rear-surface forming section 205*c*, and in addition thereto, the stationary mold portion 204 is furnished with an end-surface forming section 205*d* for forming the end surface 563*b* of the short-side section 563, an end-surface forming section 205*e* for forming the end surface 563*c* of the short-side section 563, and an end-surface forming section 205*f* for forming the end surface 562*d* of the long-side section 562. And, the movable mold portion 206 is furnished with only the adhering-surface forming section 207*a*. In this case, when the stationary mold portion 204 and the movable mold portion 206 overlap, the boundary surface 221 between the stationary mold portion 204 and the movable mold portion 206 is located on the same position as the adhering-surface forming section 207*a*, in a direction from the abutting-surface forming section 205*a* toward the adhering-surface forming section 207*a*. Therefore, the flash 564 that is created in injection molding is located on the adhering surface 563*a* (more specifically, the edge of the adhering surface 563*a*). When the adhering surface 563*a* and the rubber-supporting section 566 adhere to each other, a part of the adhering surface 563*a* does not adhere to the rubber-supporting section 566 because the flash 564 that is created on the adhering surface 563*a* comes in contact with the rubber-supporting section 566 to create a gap between the adhering surface 563*a* and the rubber-supporting section 566. As a result thereof, there is a possibility in which this makes the precision of the restriction blade 560 that is manufactured deteriorate.

On the other hand, in this embodiment, in a step in which the rubber section 561 is molded by injection molding, the rubber section 561 is molded by injection molding by injecting thermoplastic elastomer of the rubber section 561 into the mold 202 wherein the stationary mold portion 204 and the movable mold portion 206 overlap such that the boundary surface 221 between the stationary mold portion 204 and the movable mold portion 206 is located between these two molds in a direction from the abutting-surface forming section 205*a* toward the adhering-surface forming section 207*a* (the up-and-down direction shown in FIG. 15), as shown in FIG. 15.

In such a case, even if the flash 564 is created on the section of the boundary surface 221 when molding by injection molding, the flash 564 is located away from the adhering surface 563*a* in the thickness direction. Therefore, when the adhering surface 563*a* and the rubber-supporting section 566 adhere to each other, the flash 564 is unlikely to contact the rubber-supporting section 566. Accordingly, the adhering surface 563*a* properly adheres to the rubber-supporting section 566. This improves the precision of the restriction blade 560 that is manufactured.

Other Embodiments According to First Embodiment

Though the image forming apparatus, etc. according to the invention is described above based on the first embodiment, the above-mentioned embodiment of the invention is provided for facilitating the understanding of the invention, and is not to be interpreted as limiting the invention. As a matter of course, the invention can be altered and improved without departing from the gist thereof and the invention includes equivalents thereof.

Note that, in the above-mentioned first embodiment, a photoconductor that is an image bearing body is described with a structure in which a photoconductive layer is provided on an outer peripheral surface of a cylindrical conductive base, but the invention is not limited thereto. For example, a so-called photoconductive belt structured by providing a photoconductive layer on a surface of a belt-like conductive base may be used.

Note that, in the above-mentioned first embodiment, the rubber section 561 is molded by injection-molding, but the invention is not limited thereto. For example, the rubber section 561 may be molded by extrusion molding, centrifugal forming, or the like.

However, if the rubber section 561 is molded by injection molding, flashes are likely to be created on the rubber section 561 that is molded by injection molding. Therefore, an effect generated by positioning the flash 564 on the side close to the adhering surface 563*a* in the thickness direction, that is, an effect that a layer thickness of toner borne by the developing roller 510 is restricted evenly, is achieved more effectively. Accordingly, the above-mentioned first embodiment is more preferable.

Further, in the above-mentioned first embodiment, as shown in FIG. 8, the base 564*a* of the flash 564 is located between the abutting surface 562*a* and the adhering surface 563*a* in the thickness direction. And, the flash 564 includes the flash 564*b* whose edge is located on the side close to the abutting surface 562*a* with respect to the base 564*a* in the thickness direction, and the flash 564*c* whose edge is located on the side close to the adhering surface 563*a* with respect to the base 564*a* in the thickness direction. However, the invention is not limited thereto. For example, the flash 564 may include only flash 564*c* whose edge is located on the side close to the adhering surface 563*a* with respect to the base 564*a*.

However, if the flash 564 includes the flash 564*b* in addition to the flash 564*c*, the flash 564 is located more unevenly in the thickness direction than in the case in which the flash 564 includes only the flash 564*c*. This increases the possibility to make a layer thickness of toner uneven in the axial direction of the developing roller 510. Therefore, an effect generated by positioning the flash 564 on the side close to the adhering surface 563*a* in the thickness direction, that is, an effect that a layer thickness of toner borne by the developing roller 510 is restricted evenly, is achieved more effectively. Accordingly, the above-mentioned first embodiment is more preferable.

Further, in the above-mentioned first embodiment, as shown in FIG. 8, the rubber section 561 includes the first portion (the long-side section 562) that includes the abutting surface 562*a* and that is located on a one-end side in the thickness direction, and the second portion (the short-side section 563) that includes the adhering surface 563*a* and that is located on an other-end side in the thickness direction and is connected to the long-side section 562. And, the length of the long-side section 562, in the transverse direction of the rubber section 561 (the length L1 shown in FIG. 8) is larger than the length of the short-side section 563 in the transverse direction (the length L2 shown in FIG. 8). However, the invention is not limited thereto. For example, the length L1 of the long-side section 562 in the transverse direction may be smaller than the length L2 of the short-side section 563 in the transverse direction.

Further, in the above-mentioned first embodiment, as shown in FIG. 8, the base 564*a* of the flash 564 is located on the edge of the surface (the end surface 562*d*), of the long-side section 562, that is located on the opposite side from the abutting surface 562*a*. And, the length of the long-side section 562 in the thickness direction (the length h1 shown in FIG. 8) is larger than the length of the short-side section 563 in the thickness direction (the length h2 shown in FIG. 8). However, the invention is not limited thereto. For example, the base 564*a* of the flash 564 may be located on an edge of any surface other than the end surface 562*d*.

However, if the base 564*a* of the flash 564 is located on the edge of the end surface 562*d*, when the length h1 of the long-side section 562 in the thickness direction is configured larger than the length h2 of the short-side section 563 in the thickness direction, it is possible to position the flash 564 on the side close to the adhering surface 563*a* in the thickness direction, even in a simple configuration. Accordingly, the above-mentioned first embodiment is more preferable.

Further, in the above-mentioned first embodiment, the ten-point average height of irregularities Rz of the abutting surface 562*a* is smaller than the ten-point average height of irregularities Rz of the adhering surface 563*a*, but the invention is not limited thereto. For example, the ten-point average height of irregularities Rz of the abutting surface 562*a* may be larger than the ten-point average height of irregularities Rz of the adhering surface 563*a*.

However, if the ten-point average height of irregularities Rz of the abutting surface 562*a* is smaller than the ten-point average height of irregularities Rz of the adhering surface 563*a*, projections and depressions of the abutting surface 562*a* become smaller. As a result thereof, a layer thickness of toner borne by the developing roller 510 is restricted more evenly. Accordingly, the above-mentioned first embodiment is more preferable.

Further, in the above-mentioned first embodiment, as shown in FIG. 8, the first curve (curve R1) is formed on the edge of the abutting surface 562*a*, and the second curve (curve R2) is formed on the edge of the adhering surface 563*a*. And, the radius of curvature of the curve R1 is smaller than the radius of curvature of the curve R2. However, the invention is not limited thereto. For example, the radius of curvature of the curve R1 may be the same as the radius of curvature of the curve R2.

However, if the radius of curvature of the curve R1 is smaller than the radius of curvature of the curve R2, the edge of the abutting surface 562*a* on which the curve R1 is formed can be sharpened. In such a case, the edge of the abutting surface 562*a* can more easily divide toner that has reached the edge into a flow that moves the toner to the gap A and a flow that moves the toner to any place other than the gap A. Therefore, toner is effectively brought into the gap A. Accordingly, the above-mentioned first embodiment is more preferable.

Further, in the above-mentioned first embodiment, the rubber section 561 is made of thermoplastic elastomer, but the invention is not limited thereto. For example, the rubber section 561 may be made of thermosetting polyurethane.

However, if the rubber section 561 is made of thermoplastic elastomer, the rubber section 561 is easy to be molded by injection molding. Here, in the case of injection molding, the rubber section 561 can be molded such that a thickness of the rubber section 561 (a length in the thickness direction between the abutting surface 562*a* and the adhering surface 563*a*) is accurate. Therefore, if the rubber section 561 is made of thermoplastic elastomer, the rubber section 561 with great accuracy of thickness can be molded. Accordingly, the above-mentioned first embodiment is more preferable.

Further, in the above-mentioned first embodiment, the developer-bearing body is a developer-bearing roller (the developing roller 510) that is rotatable about its central axis, and the longitudinal direction of the rubber section 561 is along the axial direction of the developing roller 510. In addition, the base 564*a* of the flash 564 is located between the abutting surface 562*a* and the adhering surface 563*a* in the thickness direction, and the flash 564 includes the flash 564*b* whose edge is located on the side close to the abutting surface 562*a* with respect to the base 564*a* in the thickness direction, and the flash 564*c* whose edge is located on the side close to the adhering surface 563*a* with respect to the base 564*a* in the thickness direction. And, as shown in FIG. 7, the flash 564 is located from the longitudinal-direction one end to the longitudinal-direction other end of the rubber section 561. However, the invention is not limited thereto. For example, the flash 564 may be located on only part of the longitudinal direction, such as the longitudinal-direction central section of the rubber section 561.

If the flash 564 includes the flash 564*b* and the flash 564*c* as mentioned above, the possibility to make a layer thickness of toner uneven in the axial direction of the developing roller 510 will increase. If the flash 564 is located from the longitudinal-direction one end to the longitudinal-direction other end, it is likely to make a layer thickness of toner more uneven in the axial direction of the developing roller 510. In such a case, an effect generated by positioning the flash 564 on the side close to the adhering surface 563*a* in the thickness direction, that is, an effect that layer thickness of toner borne by the developing roller 510 is restricted evenly, can be achieved more effectively. Accordingly, the above-mentioned first embodiment is more preferable.

Further, in the above-mentioned first embodiment, as shown in FIG. 5, the developing devices 51, 52, 53, 54 each include the supporting member (the rubber-supporting section 566) to which the adhering surface 563*a* adheres and that is for supporting the rubber section 561. And, none of the flashes 564 is in contact with the rubber-supporting section 566. However, the invention is not limited thereto. For example, some of the flashes 564 may be in contact with the rubber-supporting section 566.

If some of the flashes 564 are in contact with the rubber-supporting section 566, there is a possibility in which a part of the adhering surface 563*a* does not adhere to the rubber-supporting section 566 when making the rubber-supporting section 566 and the adhering surface 563*a* adhere to each other; for example, this is caused by contact of the flash 564 with the rubber-supporting section 566 such that the flash 564 creates a gap between the adhering surface 563*a* and the rubber-supporting section 566. In such a case, there is a high possibility in which the rubber section 561 is inappropriately supported by the rubber-supporting section 566, so that there is a possibility in which the rubber section 561 improperly abuts against the developing roller 510. On the other hand, if none of the flashes 564 is in contact with the rubber-supporting section 566, the adhering surface 563*a* properly adheres to the rubber-supporting section 566. As a result thereof, the rubber section 561 is appropriately supported by the rubber-supporting section 566. Accordingly, the above-mentioned first embodiment is more preferable.

Further, in the above-mentioned first embodiment, as shown in FIG. 4, the abutting position at which the rubber section 561 abuts against the developing roller 510 is located lower than the central axis of the developing roller 510. In addition, the rubber section 561 abuts against the developing roller 510 such that the one end of the rubber section 561 in the transverse direction points toward the upstream side of the rotating direction of the developing roller 510, and the abutting position is located away from the one end in the transverse direction. However, the invention is not limited thereto. For example, the abutting position may be on the one end in the transverse direction.

Further, in the above-mentioned first embodiment, as shown in FIG. 15, the depth of the first depression (the stationary-mold recess 205) is larger than the depth of the second depression (the movable-mold recess 207), but the invention is not limited thereto. For example, the depth of the stationary-mold recess 205 may be smaller than the depth of the movable-mold recess 207.

As mentioned above, the restriction blade 560 restricts a layer thickness of toner borne by the developing roller 510. If the flash of the rubber section 561 that is molded by injection molding is located on the side close to the abutting surface 562*a* in the thickness direction, there is a possibility in which a layer thickness of toner is restricted unevenly. On the other hand, if the depth of the stationary-mold recess 205 is larger than the depth of the movable-mold recess 207, the flash 564 that is created between the stationary-mold recess 205 and the movable-mold recess 207 in injection molding is located on the side close to the adhering surface 563*a* among the abutting surface 562*a* and the adhering surface 563*a* in the thickness direction. Therefore, this enables to prevent a layer thickness of toner borne by the developing roller 510 from being restricted unevenly.

Further, in the above-mentioned first embodiment, as shown in FIG. 15, the width of the stationary-mold recess 205 in the transverse direction is larger than the width of the movable-mold recess 207 in the transverse direction, but the invention is not limited thereto. For example, the width of the stationary-mold recess 205 in the transverse direction may be the same as the width of the movable-mold recess 207 in the transverse direction.

There are cases in which the stationary mold portion 204 and the movable mold portion 206 overlap with their positions relative to each other being shifted when the mold 202 is closed. In such a case, if the width of the stationary-mold recess 205 in the transverse direction is the same as the width of the movable-mold recess 207 in the transverse direction, when the stationary mold portion 204 and the movable mold portion 206 overlap with their relative positions being shifted, a position at which the flash is created in injection molding is likely to vary (more specifically, the flash is positioned on the long-side section 562, or on the short-side section 563). If the position at which the flash is created is likely to vary, it is necessary to design the rubber section 561 giving consideration to the variation, and there is a possibility that limits in terms of designing increase excessively. On the other hand, if the width of the stationary-mold recess 205 in the transverse direction is larger than the width of the movable-mold recess 207 in the transverse direction, even when the stationary mold portion 204 and the movable mold portion 206 overlap with their positions relative to each other being shifted, position at which the flash 564 is created does not vary (more specifically, the flash is located on only the long-side section 562). Accordingly, the above-mentioned first embodiment is more preferable.

Further, in the above-mentioned first embodiment, as shown in FIG. 9, a method for manufacturing the restriction blade 560 further includes a step in which the shape of the rubber section 561 is adjusted by cutting both end sections (the cutting section 565*f*) of the rubber section 561 that is molded by injection molding in the longitudinal direction. And, in the step for making the adhering surface 563*a* of the rubber section 561 and the rubber-supporting section 566 adhere to each other, the adhering surface 563*a* of the rubber section 561 whose shape is adjusted and the rubber-supporting section 566 adhere to each other. However, the invention is not limited thereto. For example, a method for manufacturing the restriction blade 560 may exclude a step in which the shape of the rubber section 561 is adjusted by cutting both end sections of the rubber section 561.

However, if the shape of the rubber section 561 is adjusted by cutting the cutting section 565*f* of the rubber section 561 that is molded by injection molding, the flash is not positioned in the transverse direction of the rubber section 561. Therefore, the adhering surface 563*a* of the rubber section 561 and the rubber-supporting section 566 can adhere to each other more properly. Accordingly, the above-mentioned first embodiment is more preferable.

Further, in the above-mentioned first embodiment, as shown in FIGS. 20B and 20C, in the step for making the adhering surface 563*a* of the rubber section 561 and the rubber-supporting section 566 adhere to each other, the adhering surface 563*a* of the rubber section 561 and the rubber-supporting section 566 adhere to each other such that the flash 564 of the rubber section 561 that is molded by injection molding is not in contact with the rubber-supporting section 566. However, the invention is not limited thereto. For example, the adhering surface 563*a* and the rubber-supporting section 566 may adhere to each other such that a part of the flash 564 of the rubber section 561 that is molded by injection molding is in contact with the rubber-supporting section 566.

However, if the adhering surface 563*a* and the rubber-supporting section 566 adhere to each other such that the flash 564 of the rubber section 561 that is molded by injection molding is not in contact with the rubber-supporting section 566, the adhering surface 563*a* and the rubber-supporting section 566 can adhere to each other more properly. Accordingly, the above-mentioned first embodiment is more preferable.

Further, in the above-mentioned first embodiment, as shown in FIGS. 20A through 20D, the step for making the adhering surface 563*a* of the rubber section 561 and the rubber-supporting section 566 adhere to each other includes: a step in which the rubber-supporting section 566 is held by the first jig (the placing table 310), a step in which the rubber section 561 is held by the revolving member 320 such that the flash 564 of the rubber section 561 that is molded by injection molding is not in contact with the second jig (the revolving member 320), and a step in which the adhering surface 563*a* and the rubber-supporting section 566 adhere to each other in such a manner as to move the placing table 310 holding the rubber-supporting section 566 relative to the revolving member 320 holding the rubber section 561 so as to become close to each other such that the adhering surface 563*a* of the rubber section 561 comes in contact with the rubber-supporting section 566. However, the invention is not limited thereto. For example, the rubber section 561 may be held by the revolving member 320 such that a part of the flash 564 of the rubber section 561 that is molded by injection molding is contact with the revolving member 320.

If the revolving member 320 holds the rubber section 561 such that a part of the flash 564 is in contact with the revolving member 320, there are cases in which the flash 564 is sandwiched between the rubber section 561 and the revolving member 320 when the rubber section 561 is held by the revolving member 320. In such a case, the rubber section 561 is not positioned precisely with respect to the revolving member 320. On the other hand, if the rubber section 561 is held by the revolving member 320 such that the flash 564 of the rubber section 561 that is molded by injection molding is not in contact with the revolving member 320, the flash 564 is not sandwiched between the rubber section 561 and the revolving member 320. Therefore, the rubber section 561 is properly positioned with respect to the revolving member 320. Accordingly, the above-mentioned first embodiment is more preferable.

SECOND EMBODIMENT

Regarding Restriction Blade According to Second Embodiment

In this section, other embodiments of a restriction blade (a restriction blade according to the second embodiment) are described. Note that the restriction blade is provided on the developing device included in the image forming apparatus, and restricts a layer thickness of toner borne by the developing roller by abutting against the developing roller. The image forming apparatus and the developing device are not described in this section since these apparatus and device are the approximately same as those described in the first embodiment.

A restriction blade 1560 has a function as a charging blade that is for charging toner T borne by the developing roller 510, and also has a function to restrict a layer thickness of the toner T. The restriction blade 1560 includes a charging member 1562 and a supporting member 1564, as shown in FIGS. 22 and 23.

The charging member 1562 is for electrically charging toner T borne on the developing roller 510 by providing electrical charges to the toner T while abutting against the developing roller 510. In this embodiment, the toner T is negatively charged as a result of being rubbed with the charging member 1562 and receiving electrons when the toner T passes through a position at which the charging member 1562 abuts against the developing roller 510. The toner T is used for development of a latent image formed on the photoconductor 20 while being negatively charged. In short, the charging member 1562 according to this embodiment serves to negatively charge the toner T.

The charging member 1562 is a member made of thermoplastic elastomer that is located on a side, of the triboelectric series, closer to a polarity (that is, positive polarity) that is opposite from a polarity for charging toner than urethane rubber. Note that material of the charging member 1562 will be described in detail later.

Figure 22:
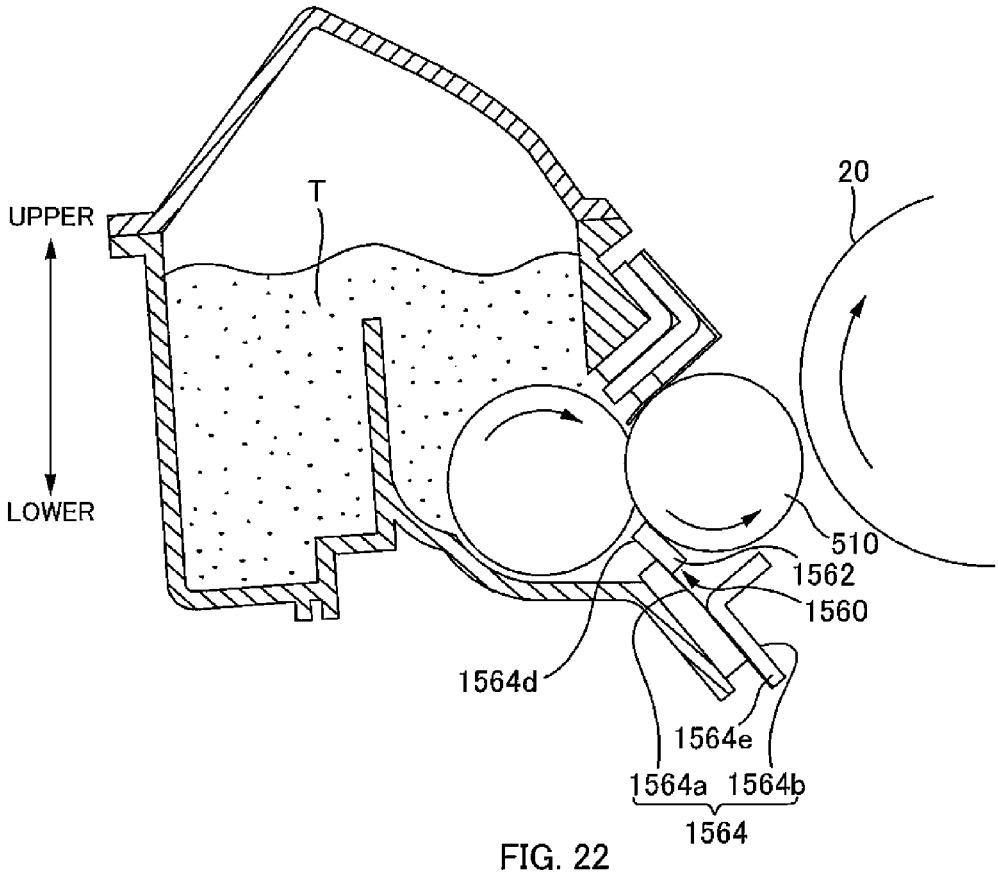
FIG. 22 is a cross-sectional view showing main structural components of a developing device according to the second embodiment.
Figure 23:
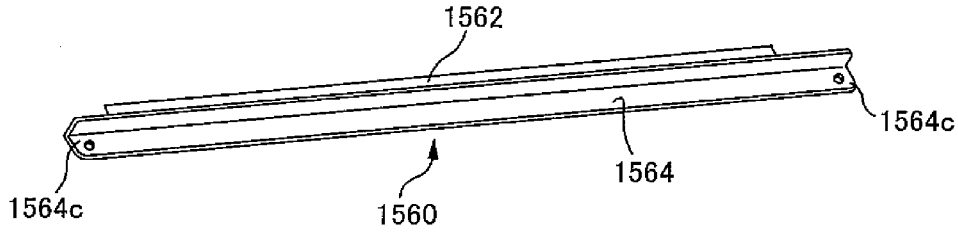
FIG. 23 is a perspective view of a restriction blade 560 according to the second embodiment.

Further, as shown in FIG. 22, a cross-sectional shape with respect to a longitudinal direction of the charging member 1562 is a short shape, and the charging member 1562 is supported by the supporting member 1564 (more precisely, by a thin plate 1564*a* to be described later) with the longitudinal direction being along a longitudinal direction of the supporting member 1564 that will be described later.

Note that centrifugal forming, extrusion molding, injection molding, etc. are exemplified as a method for molding the charging member 1562 that has the above-mentioned cross-sectional shape, and that all of these methods can be used without limitation. Since the charging member 1562 is made of thermoplastic elastomer in this embodiment, it is possible to mold accurately and easily the charging member 1562 having a desired shape if injection molding is selected among the above-mentioned methods.

The supporting member 1564 consists of the thin plate 1564*a* and a thin-plate supporting section 1564*b*. At a lateral-direction one end section 1564*d* (that is, an end section on a side close to the thin plate 1564*a*) of the supporting member 1564, the charging member 1562 is supported. The thin plate 1564*a* is a metal member that is made of phosphor bronze, stainless steel, etc. and that has a spring-like characteristic. Urging force of the thin plate 1564*a* makes the charging member 1562 that is supported by the thin plate 1564*a* abut against the developing roller 510. The thin-plate supporting section 1564*b* is a metal plate that is arranged on a lateral-direction other end section 1564*e* of the supporting member 1564, and is attached to the thin plate 1564*a* while supporting an end, of the thin plate 1564*a*, opposite from the end that supports the charging member 1562. Note that material of the thin plate 1564*a* is not limited to the above-mentioned metal, and polymeric materials, such as plastic, may be used as other material. Further, in this embodiment, the charging member 1562 adheres to and is fixed on the thin plate 1564*a* with a double-sided adhesive tape, etc., but the invention is not limited thereto. For example, the charging member 1562 may also be molded by solidification after injecting molten thermoplastic elastomer into a mold into which the thin plate 1564*a* is entered.

The restriction blade 1560 is attached to a not-shown holder with the longitudinal-direction both end section 1564*c* of thin-plate supporting section 1564*b* being supported by the holder.

Material of Charging Member 1562

Polymeric materials, such as urethane rubber and thermoplastic elastomer, are used for material of the charging member 1562. In this section, definitions of urethane rubber and thermoplastic elastomer in this embodiment are described.

Polymeric materials include an elastic body which has rubber elasticity (elastomer in a broad sense) and an inelastic body which does not have rubber elasticity (plastomer). The elastic body is classified into rubber and thermoplastic elastomer based on behavior of the material under heating, and the inelastic body is classified into plastic and thermosetting resin. In this embodiment, among the above-mentioned elastic bodies, an elastic body that is solidified by heating from its liquid state (that is, an elastic body showing thermosetting property) is defined as rubber, and an elastic body that is liquefied by heating from its solid state (that is, an elastic body showing thermoplasticity) is defined as thermoplastic elastomer. Besides, urethane rubber is defined as material that belongs to the above-mentioned rubber and is made of polyurethane resin.

Thermoplastic elastomer is easy to be processed because of its thermoplasticity. If this material is used as material of the charging member 1562, the charging member 1562 that is accurately molded in a desired shape can be obtained. If thermoplastic elastomer is used as material of the charging member 1562, the accuracy of attaching when attaching the charging member 1562 becomes higher than the cases in which the urethane rubber is used. As a result thereof, it is possible to make the charging member 1562 abut against the developing roller 510 more properly.

However, while thermoplastic elastomer has the above-mentioned advantages, thermoplastic elastomer is inferior to the urethane rubber in terms of wear resistance, etc. . . . Therefore, if the charging member 1562 made of thermoplastic elastomer is used, an abutting pressure at which the charging member 1562 abuts against the developing roller 510 is as difficult to increase as when using the charging member 1562 made of urethane rubber. This makes it difficult to appropriately charge the toner T, so that there are cases in which the quality of an image that is finally formed on a medium deteriorates.

Figure 24:
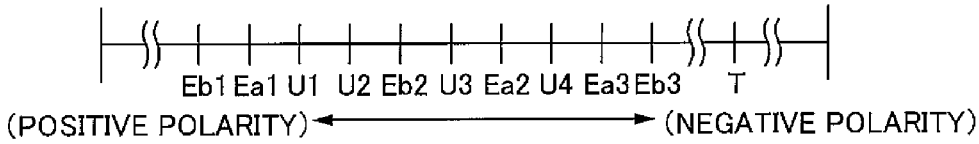
FIG. 24 is a diagram showing positions, in the triboelectric series, of ether-based elastomers Ea1, Ea2, Ea3, ester-based elastomers Eb1, Eb2, Eb3, urethane rubbers U1, U2, U3, U4, and toner T according to the second embodiment.

Therefore, in this embodiment, thermoplastic elastomer that can solve the above-mentioned problem and is appropriate to material of the charging member 1562 is used. Here, thermoplastic elastomer according to this embodiment is described with reference to FIG. 24. FIG. 24 is a diagram showing positions, in the triboelectric series, of ether-based elastomers Ea1, Ea2, Ea3, ester-based elastomers Eb1, Eb2, Eb3, urethane rubbers U1, U2, U3, U4, and toner T according to this embodiment. Note that, in FIG. 24, positive-negative direction of charging is indicated by the arrow, and items that are likely to be positively charged are located closer to positive polarity, and items that are likely to be negatively charged are located closer to negative polarity. For example, the urethane rubber U1 is more likely to be positively charged than the urethane rubber U2. When the urethane rubber U1 and the urethane rubber rub together, the urethane rubber U1 is positively charged and the urethane rubber U2 is negatively charged.

Thermoplastic elastomer consists of a soft segment that shows remarkable rubber elasticity and a hard segment that is a phase that constrains molecules. The ether-based elastomers Ea1, Ea2, Ea3 are elastomers that include polyether as the soft segment. On the other hand, the ester-based elastomers Eb1, Eb2, Eb3 are elastomers that include polyester as the soft segment. In developing device according to this embodiment, the charging member 1562 made of the ether-based elastomer Ea1 among the thermoplastic elastomers is provided.

If the thermoplastic elastomer Ea1 is used for material of the charging member 1562, the charging member 1562 can be accurately molded in a desired shape as mentioned above. Therefore, it is possible to obtain a charging member 1562 that has higher accuracy of attaching than the cases in which any of urethane rubber U1, U2, U3, U4 is used.

Further, the ether-based elastomer Ea1 is located closer to positive polarity than the urethane rubbers U1, U2, U3, U4 in the triboelectric series, as shown in FIG. 24. Here, in this embodiment, because toner T is used for development of a latent image while being negatively charged, material that is located closer to positive polarity in the triboelectric series has larger capacity to charge the toner T. If the charging member 1562 made of material having larger capacity of charging is used, an abutting pressure at which the charging member 1562 abuts against the developing roller 510 can be set smaller. Here, because the ether-based elastomer Ea1 has larger capacity to charge toner T than the urethane rubbers U1, U2, U3, U4, it is unnecessary to increase the abutting pressure of the cases in which the charging member 1562 made of the ether-based elastomer Ea1 is used, up to an abutting pressure of the cases in which the charging member 1562 made of each of urethane rubbers U1, U2, U3, U4 is used. In short, the charging member 1562 made of the thermoplastic elastomer Ea1 enables to provide sufficient electrical charges to toner T on the developing roller 510 without wear occurring. Accordingly, if the thermoplastic elastomer Ea1 is used as material of the charging member 1562, it is possible to obtain the charging member 1562 that enables to appropriately charge toner T while maintaining the original advantage of thermoplastic elastomer that molding accuracy of thermoplastic elastomer is higher than that of urethane rubber.

Further, in this embodiment, the ether-based elastomer Ea1 is used as material of the charging member 1562, but the invention is not limited thereto. For example, the ester-based elastomer Eb1 may be used. However, comparing ether-based elastomer (for example, the ether-based elastomer Ea1 in FIG. 24) and ester-based elastomer (for example, the ester-based elastomer Eb1 in FIG. 24), the former is superior in terms of electrical insulation performance and is preferable as material of the charging member 1562. In addition, because polyether does not hydrolyze unlike polyester, deterioration over time caused by hydrolysis can be suppressed in the charging member 1562 made of ether-based elastomer. In terms of the above-mentioned points, ether-based elastomer is more preferable as material of the charging member 1562.

Further, in this embodiment, the charging member 1562 is made of thermoplastic elastomer that negatively charges toner T and that is located closer to positive polarity than urethane rubber in the triboelectric series, but the invention is not limited thereto. For example, by using developer that is located closer to positive polarity than urethane rubber and thermoplastic elastomer in the triboelectric series, the charging member 1562 may positively charge this developer (that is, in the image forming apparatus, the developer is used for development of a latent image while being positively charged). In such a case, the charging member 1562 made of thermoplastic elastomer that is located closer to negative polarity than urethane rubber in the triboelectric series (for example, the ether-based elastomer Ea3 or the ester-based elastomer Eb3 shown in FIG. 24) may be used.

Configuration of Image Forming System, etc.

Next, an embodiment of an image forming system that is an example of the embodiments according to the invention is described with reference to the drawings.

Figure 25:
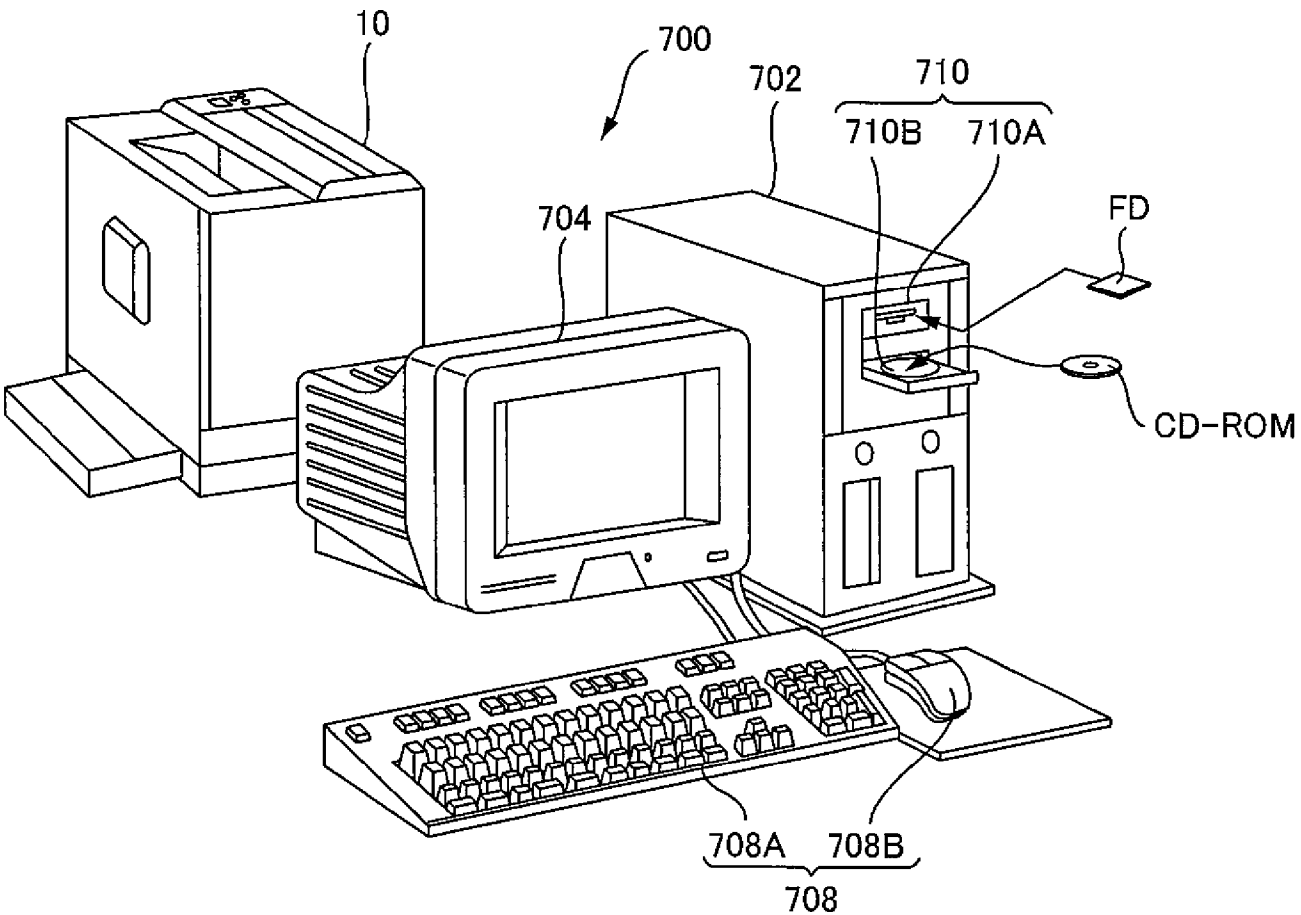
FIG. 25 is an explanatory diagram showing an external structure of an image forming system.

FIG. 25 is an explanatory diagram showing an external structure of the image forming system. An image forming system 700 includes a computer 702, a display device 704, the printer 10, input devices 708, and reading devices 710.

In this embodiment, the computer 702 is accommodated in a mini-tower type enclosure, but the invention is not limited thereto. Regarding the display device 704, a CRT (Cathode Ray Tube), a plasma display, a liquid crystal display device, and the like are generally used, but the invention is not limited thereto. Regarding the printer 10, the printer described above is used. A keyboard 708A and a mouse 708B are used as the input devices 708 in this embodiment, but the invention is not limited thereto. A flexible disk drive device 710A and a CD-ROM drive device 710B are used as the reading devices 710 in this embodiment, but the invention is not limited thereto. For example, a MO (a Magneto Optical) disk drive apparatus, a DVD (a Digital Versatile Disk) and the like may also be used.

Figure 26:
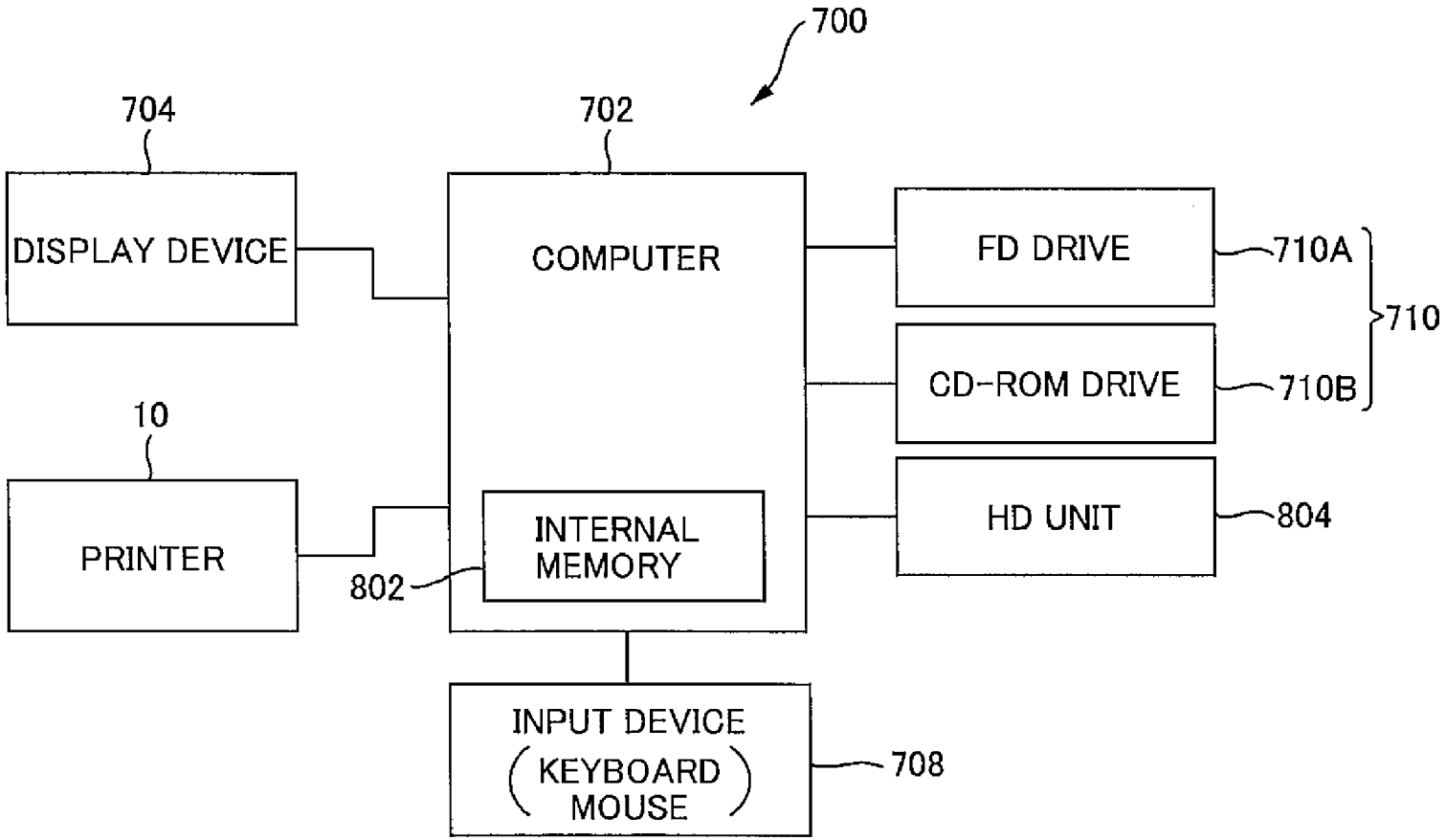
FIG. 26 is a block diagram showing the configuration of the image forming system shown in FIG. 25.

FIG. 26 is a block diagram showing the configuration of the image forming system shown in FIG. 25. Further provided are an internal memory 802, such as a RAM, inside the enclosure accommodating the computer 702, and an external memory, such as a hard disk drive unit 804.

Note that, in the above description, an example of the image forming system having the configuration in which the printer 10 is connected to the computer 702, the display device 704, the input devices 708, and the reading devices 710 is described. However, the invention is not limited thereto. For example, the image forming system may be composed of the computer 702 and the printer 10, or the image forming system may be constructed without any of the display device 704, the input devices 708 and the reading devices 710.

Further, for example, the printer 10 may have some of functions or mechanisms of the computer 702, the display device 704, the input devices 708, and the reading devices 710. As an example, the printer 10 may be configured having an image processing section for performing image processing, a displaying section for performing various types of displays, and a recording-media attach/detach section to and from which a recording medium storing image data captured by a digital camera or the like is inserted and taken out.

As an overall system, the image forming system that is achieved as mentioned above becomes superior to prior systems.

What is claimed is:

1. A layer-thickness restriction member, comprising:

an abutting surface that is for abutting against a developer-bearing body in order to restrict a layer thickness of developer borne by the developer-bearing body; and a flash that is located on a side close to a non-abutting surface that is located on an opposite side from the abutting surface in a thickness direction of the layer-thickness restriction member, wherein a first curve is formed on an edge of the abutting surface, a second curve is formed on an edge of the non-abutting surface, and a radius of curvature of the first curve is smaller than a radius of curvature of the second curve.

2. A layer-thickness restriction member according to claim 1, wherein:

a base of the flash is located between the abutting surface and the non-abutting surface in the thickness direction; and the flash includes a flash whose edge is located on a side close to the abutting surface with respect to the base in the thickness direction, and a flash whose edge is located on a side close to the non-abutting surface with respect to the base in the thickness direction.

3. A layer-thickness restriction member according to claim 1, wherein:

the layer-thickness restriction member includes a first portion that includes the abutting surface and that is located on a one-end side in the thickness direction, and a second portion that includes the non-abutting surface and that is located on an other-end side in the thickness direction and is connected to the first portion; and a length of the first portion in a transverse direction of the layer-thickness restriction member is larger than a length of the second portion in the transverse direction.

4. A layer-thickness restriction member according to claim 3, wherein:

a base of the flash is located on an edge of a surface, of the first portion, that is located on the opposite side from the abutting surface; and a length of the first portion in the thickness direction is larger than a length of the second portion in the thickness direction.

5. A layer-thickness restriction member according to claim 1, wherein:

a ten-point average height of irregularities of the abutting surface is smaller than a ten-point average height of irregularities of the non-abutting surface.

6. A layer-thickness restriction member according to claim 1, wherein:

the layer-thickness restriction member is made of thermoplastic elastomer.

7. A developing device, comprising:

a developer-bearing body that is for bearing developer; and a layer-thickness restriction member that includes an abutting surface that is for abutting against the developer-bearing body in order to restrict a layer thickness of developer borne by the developer-bearing body, and that includes a flash that is located on a side close to a non-abutting surface that is located on an opposite side from the abutting surface in a thickness direction of the layer-thickness restriction member, wherein a first curve is formed on an edge of the abutting surface, a second curve is formed on an edge of the non-abutting surface, and a radius of curvature of the first curve is smaller than a radius of curvature of the second curve.

8. A developing device according to claim 7, wherein:

the developer-bearing body is a developer-bearing roller that is rotatable about a central axis;

a longitudinal direction of the layer-thickness restriction member is along an axial direction of the developer-bearing body;

a base of the flash is located between the abutting surface and the non-abutting surface in the thickness direction;

the flash includes a flash whose edge is located on a side close to the abutting surface with respect to the base in the thickness direction, and a flash whose edge is located on a side close to the non-abutting surface with respect to the base in the thickness direction; and the flash is located from a longitudinal-direction one end to a longitudinal-direction other end of the layer-thickness restriction member.

9. A developing device according to claim 7, wherein:

the developing device includes a supporting member to which the non-abutting surface adheres and that is for supporting the layer-thickness restriction member; and none of the flashes is in contact with the supporting member.

* * * * *